US010324388B2

(12) United States Patent
Kabata et al.

(10) Patent No.: US 10,324,388 B2
(45) Date of Patent: Jun. 18, 2019

(54) TONER, TONER STORED UNIT, IMAGE FORMING APPARATUS, AND IMAGE FORMING METHOD

(71) Applicants: Toshiyuki Kabata, Kanagawa (JP); Takashi Bisaiji, Kanagawa (JP); Maiko Koeda, Shizuoka (JP); Katsunori Kurose, Shizuoka (JP)

(72) Inventors: Toshiyuki Kabata, Kanagawa (JP); Takashi Bisaiji, Kanagawa (JP); Maiko Koeda, Shizuoka (JP); Katsunori Kurose, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 67 days.

(21) Appl. No.: 15/456,890

(22) Filed: Mar. 13, 2017

(65) Prior Publication Data

US 2017/0269489 A1 Sep. 21, 2017

(30) Foreign Application Priority Data

Mar. 18, 2016 (JP) ..... 2016-055320
Feb. 14, 2017 (JP) ..... 2017-025303

(51) Int. Cl.

*G03G 9/097* (2006.01)
*G03G 9/08* (2006.01)
*G03G 13/08* (2006.01)
*G03G 15/08* (2006.01)

(52) U.S. Cl.

CPC ..... *G03G 9/0819* (2013.01); *G03G 9/09708* (2013.01); *G03G 9/09725* (2013.01); *G03G 9/09766* (2013.01); *G03G 13/08* (2013.01); *G03G 15/08* (2013.01)

(58) Field of Classification Search

CPC ..... G03G 9/09708; G03G 9/09725; G03G 9/0819; G03G 15/08; G03G 9/08755; G03G 9/09766; G03G 13/08

See application file for complete search history.

(56) References Cited

U.S. PATENT DOCUMENTS 2,297,691 A * 10/1942 Carlson ..... G03G 5/08207 101/467
3,718,936 A * 2/1973 Rice, Jr. ..... B41J 2/395 174/261
3,742,516 A * 6/1973 Cavanaugh ..... G03G 15/323 250/315.3
4,678,318 A 7/1987 Bisaiji
4,837,597 A 6/1989 Bisaiji
4,875,079 A 10/1989 Bisaiji et al.
5,107,302 A 4/1992 Bisaiji
5,227,842 A 7/1993 Hayashi et al.
5,258,248 A 11/1993 Tokuhashi et al.
5,270,783 A 12/1993 Bisaiji et al.
5,278,613 A 1/1994 Bisaiji et al.
5,371,579 A 12/1994 Bisaiji
5,402,220 A 3/1995 Tanaka et al.
5,410,339 A 4/1995 Bisaiji et al.
5,471,282 A 11/1995 Hayashi et al.
5,701,566 A 12/1997 Bisaiji et al.
5,729,808 A 3/1998 Bisaiji
5,761,594 A 6/1998 Seto et al.
5,887,218 A 3/1999 Yuu et al.
5,913,092 A 6/1999 Bisaiji et al.
5,926,678 A 7/1999 Bisaiji
5,987,290 A 11/1999 Bisaiji
6,061,543 A 5/2000 Kayahara et al.
6,091,922 A 7/2000 Bisaiji
6,259,879 B1 7/2001 Bisaiji
6,521,388 B2 2/2003 Kabata et al.
RE38,206 E 7/2003 Bisaiji et al.
7,250,244 B2 7/2007 Miyamoto et al.
7,890,028 B2 2/2011 Miyamoto et al.
7,986,910 B2 7/2011 Kabata et al.
8,110,330 B2 2/2012 Ishikawa et al.
8,340,562 B2 12/2012 Hatakeyama et al.
8,374,537 B2 2/2013 Hatakeyama et al.
8,463,165 B2 6/2013 Kozasa et al.
8,828,475 B2 9/2014 Shionoiri et al.
8,927,186 B2 * 1/2015 Ishii ..... G03G 9/0812 430/108.1

(Continued)

FOREIGN PATENT DOCUMENTS

JP 08-015899 1/1996
JP 09-062026 3/1997

(Continued)

*Primary Examiner* — Janis L Dote

(74) *Attorney, Agent, or Firm* — Oblon, McClelland, Maier & Neustadt, L.L.P.

(57) ABSTRACT

A toner including base particles and external additives on the base particles, the toner satisfying Conditions 1 and 2 defined in the specification, when a number distribution D of particle diameters of powder particles B generated from one base particle A is calculated from a density a of the base particles A and a density b of the powder particles B, where the base particles A and the powder particles B are deposited on an adhesive area and mica respectively by feeding the toner into a vacuumed space from an inlet, and allowing the toner to crush against a surface of a substrate having the adhesive area composed of a carbon tape, and the mica disposed in a manner that the surface is orthogonal to a direction connecting between center of the vacuumed space and center of the inlet, Powder particles B: particles detached from the base particles.

9 Claims, 9 Drawing Sheets

(56) References Cited

U.S. PATENT DOCUMENTS

| | | | |
|---|---|---|---|
| 9,110,418 | B2 | 8/2015 | Kabata et al. |
| 9,146,523 | B2 | 9/2015 | Kabata et al. |
| 2001/0007616 | A1 | 7/2001 | Bisaiji |
| 2002/0018947 | A1 | 2/2002 | Kabata et al. |
| 2002/0081513 | A1 | 6/2002 | Higuchi et al. |
| 2002/0090562 | A1 | 7/2002 | Sasaki et al. |
| 2002/0102486 | A1 | 8/2002 | Higuchi et al. |
| 2002/0155368 | A1 | 10/2002 | Iwamoto et al. |
| 2002/0159797 | A1 | 10/2002 | Matsuda et al. |
| 2002/0160287 | A1 | 10/2002 | Miyamoto et al. |
| 2003/0035661 | A1 | 2/2003 | Kabata et al. |
| 2003/0073021 | A1 | 4/2003 | Sasaki et al. |
| 2003/0082472 | A1 | 5/2003 | Kondo et al. |
| 2003/0099481 | A1 | 5/2003 | Sampe et al. |
| 2003/0108362 | A1 | 6/2003 | Ohjimi et al. |
| 2003/0129511 | A1 | 7/2003 | Kabata et al. |
| 2003/0138711 | A1 | 7/2003 | Kabata et al. |
| 2003/0165760 | A1 | 9/2003 | Higuchi et al. |
| 2003/0175606 | A1 | 9/2003 | Kabata et al. |
| 2003/0219296 | A1 | 11/2003 | Kabata et al. |
| 2004/0053154 | A1 | 3/2004 | Tomita et al. |
| 2004/0076443 | A1 | 4/2004 | Suzuki et al. |
| 2004/0126147 | A1 | 7/2004 | Kondo et al. |
| 2004/0142265 | A1 | 7/2004 | Tomita et al. |
| 2004/0146795 | A1 | 7/2004 | Emoto et al. |
| 2004/0151997 | A1 | 8/2004 | Miyamoto et al. |
| 2004/0166428 | A1 | 8/2004 | Higuchi et al. |
| 2004/0166429 | A1 | 8/2004 | Higuchi et al. |
| 2004/0209181 | A1 | 10/2004 | Higuchi et al. |
| 2004/0229147 | A1 | 11/2004 | Higuchi et al. |
| 2005/0031377 | A1 | 2/2005 | Kabata et al. |
| 2005/0069357 | A1 | 3/2005 | Kabata et al. |
| 2005/0141917 | A1 | 6/2005 | Enoki et al. |
| 2005/0141919 | A1 | 6/2005 | Kitajima et al. |
| 2005/0158644 | A1 | 7/2005 | Kondo et al. |
| 2005/0181291 | A1 | 8/2005 | Kami et al. |
| 2005/0232658 | A1 | 10/2005 | Kabata et al. |
| 2005/0250036 | A1 | 11/2005 | Emoto et al. |
| 2005/0276632 | A1 | 12/2005 | Ariizumi et al. |
| 2006/0057479 | A1 | 3/2006 | Niimi et al. |
| 2006/0134540 | A1 | 6/2006 | Kondo et al. |
| 2006/0154168 | A1 | 7/2006 | Tomita et al. |
| 2006/0177749 | A1 | 8/2006 | Tamoto et al. |
| 2006/0269323 | A1 | 11/2006 | Kabata et al. |
| 2006/0275686 | A1 | 12/2006 | Kadota et al. |
| 2006/0292474 | A1 | 12/2006 | Mikuriya et al. |
| 2007/0020546 | A1 | 1/2007 | Emoto et al. |
| 2007/0026335 | A1 | 2/2007 | Yamamoto et al. |
| 2007/0059625 | A1 | 3/2007 | Yamamoto et al. |
| 2007/0104512 | A1 | 5/2007 | Hatakeyama et al. |
| 2007/0110488 | A1 | 5/2007 | Kabata et al. |
| 2007/0122729 | A1 | 5/2007 | Katoh et al. |
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0218388 | A1 | 9/2007 | Kurose et al. |
| 2007/0218390 | A1 | 9/2007 | Nozaki et al. |
| 2007/0238042 | A1 | 10/2007 | Yasunaga et al. |
| 2008/0019737 | A1 | 1/2008 | Kabata et al. |
| 2008/0032223 | A1 | 2/2008 | Yamamoto et al. |
| 2008/0038656 | A1 | 2/2008 | Yasunaga et al. |
| 2008/0063957 | A1 | 3/2008 | Murakami et al. |
| 2008/0069617 | A1 | 3/2008 | Matsumoto et al. |
| 2008/0076054 | A1 | 3/2008 | Nozaki et al. |
| 2008/0081273 | A1 | 4/2008 | Murakami et al. |
| 2008/0089726 | A1 | 4/2008 | Hatakeyama et al. |
| 2008/0096119 | A1 | 4/2008 | Yamamoto et al. |
| 2008/0101823 | A1 | 5/2008 | Katoh et al. |
| 2008/0138735 | A1 | 6/2008 | Tomita et al. |
| 2008/0176159 | A1 | 7/2008 | Matsumoto et al. |
| 2008/0181630 | A1 | 7/2008 | Matsumoto et al. |
| 2008/0193865 | A1 | 8/2008 | Kondo et al. |
| 2008/0220357 | A1 | 9/2008 | Nozaki et al. |
| 2008/0226356 | A1 | 9/2008 | Yasunaga et al. |
| 2008/0226365 | A1 | 9/2008 | Hatakeyama et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233510 | A1 | 9/2008 | Nozaki et al. |
| 2008/0233511 | A1 | 9/2008 | Ishikawa et al. |
| 2008/0253801 | A1 | 10/2008 | Hatakeyama et al. |
| 2008/0279591 | A1 | 11/2008 | Yasunaga et al. |
| 2008/0317508 | A1 | 12/2008 | Terai et al. |
| 2009/0003853 | A1 | 1/2009 | Hatakeyama et al. |
| 2009/0016769 | A1 | 1/2009 | Hatakeyama et al. |
| 2009/0016777 | A1 | 1/2009 | Miyamoto et al. |
| 2009/0017391 | A1 | 1/2009 | Yamamoto et al. |
| 2009/0017392 | A1 | 1/2009 | Higuchi et al. |
| 2009/0074432 | A1 | 3/2009 | Kita et al. |
| 2009/0220879 | A1 | 9/2009 | Matsumoto et al. |
| 2009/0263164 | A1 | 10/2009 | Koeda et al. |
| 2009/0279930 | A1 | 11/2009 | Kabata et al. |
| 2009/0290920 | A1 | 11/2009 | Hatakeyama et al. |
| 2009/0297975 | A1 | 12/2009 | Ishikawa et al. |
| 2010/0178073 | A1 | 7/2010 | Kabata et al. |
| 2010/0233609 | A1 | 9/2010 | Higuchi et al. |
| 2011/0045401 | A1 | 2/2011 | Murakami et al. |
| 2011/0064489 | A1 | 3/2011 | Bisaiji et al. |
| 2011/0085824 | A1 | 4/2011 | Hatakeyama et al. |
| 2011/0129269 | A1 | 6/2011 | Seo et al. |
| 2011/0129270 | A1 | 6/2011 | Seo et al. |
| 2011/0135361 | A1 | 6/2011 | Kabata et al. |
| 2011/0223527 | A1 | 9/2011 | Iio et al. |
| 2012/0141181 | A1 | 6/2012 | Bisaiji et al. |
| 2012/0308260 | A1 | 12/2012 | Kabata et al. |
| 2013/0011171 | A1 | 1/2013 | Tamura et al. |
| 2013/0156466 | A1 | 6/2013 | Bisaiji et al. |
| 2013/0164053 | A1 | 6/2013 | Bisaiji et al. |
| 2013/0188972 | A1 | 7/2013 | Kabata et al. |
| 2014/0255069 | A1 | 9/2014 | Iio et al. |
| 2014/0348496 | A1 | 11/2014 | Kabata et al. |
| 2015/0344804 | A1 | 12/2015 | Kabata et al. |
| 2015/0344809 | A1 | 12/2015 | Kabata et al. |
| 2015/0345614 | A1 | 12/2015 | Kabata et al. |

FOREIGN PATENT DOCUMENTS

| | | |
|---|---|---|
| JP | 09-146293 | 6/1997 |
| JP | 3129074 | 11/2000 |
| JP | 3186325 | 5/2001 |
| JP | 2006-323368 | 11/2006 |
| JP | 2008-233119 | 10/2008 |
| JP | 2014-174341 | 9/2014 |

* cited by examiner

TONER, TONER STORED UNIT, IMAGE FORMING APPARATUS, AND IMAGE FORMING METHOD

CROSS-REFERENCE TO RELATED APPLICATIONS

The present application claims priority under 35 U.S.C. § 119 to Japanese Patent Application No. 2016-055320, filed Mar. 18, 2016 and Japanese Patent Application No. 2017-025303, filed Feb. 14, 2017. The contents of which are incorporated herein by reference in their entirety.

BACKGROUND OF THE INVENTION

Field of the Invention

The present disclosure relates to a toner, a toner stored unit, an image forming apparatus, and an image forming method.

Description of the Related Art

Toners hitherto used for image formation, such as electrophotography, have been toners, where inorganic particles are externally added to toner base particles, in order to secure transferring properties within image forming apparatuses and chargeability.

However, inorganic particles externally added to toner base particles are embedded into the toner base particles by stress with a conveying member during conveyance of the toner inside a developing device. As a result, flowability of the toner is impaired, and toner supply properties, developing properties, and charging ability are deteriorated over time. Moreover, reduction in image density occurs when the toner is repeatedly used over a long period.

If the external additives are detached from the toner during developing, moreover, not only low image density and clogging of the developer are easily caused by reduction in chargeability and flowability of the toner, but also the toner is deposited and adhered onto a developing roller, an amount of scoped toner onto the area of the developing roller where the toner is adhered is reduced to cause formation of defective images.

If an amount of the external additives detached from the toner is large when the toner is transferred onto a photoconductor or an intermediate transfer belt, furthermore, filming of the external additive occurs on an entire area of the photoconductor or the intermediate transfer belt. As a result, optical properties and electric properties of the area of the photoconductor or the intermediate transfer belt where the external additives are filmed deteriorate and formation of defective images tends to be caused. An image forming apparatus typically include a cleaning system configured to remove filmed substances accumulated on a photoconductor or an intermediate transfer belt. However, a cleaning performance lowers particularly in a low-temperature and low-humidity environment, and problems tend to occur.

Meanwhile, it is difficult to completely prevent detachment of the external additives from the toner during image formation. If an appropriate amount of the external additives is supplied onto a photoconductor or an intermediate transfer belt, moreover, the supplied external additives help cleaning of the surface of the photoconductor or intermediate transfer belt. Therefore, such supply of the external additives is preferable.

In recent years, various methods have studies for producing a toner that granulated in a liquid, such as polymerization toners produced by suspension polymerization, emulsion polymerization or dispersion polymerization, in order to achieve small particle diameters and spherical shapes of toner particles. Particularly, toners having small particle sizes have a large total surface of toner base particles relatively. Therefore, it is necessary to increase an amount of external additives added in order to secure flowability of the toner. As the amount of the external additives increases, detachment of the external additives from the toner base particles tends to occur, leading to a problem that filming of the external additives increases. Accordingly, there is a need for a toner, which does not cause detachment of external additives until the toner is supplied into a developing device, and releases an appropriate amount of the external additives when the toner is transferred onto a photoconductor or an intermediate transfer belt.

As described above, a consideration of a way external additives are released from a toner is extremely important for continuously forming high-quality images. As a method for determining an easiness of external additive detaching from a toner, for example, disclosed is a wet method where vibrations are applied to a toner dispersion liquid by ultrasonic waves, and a ratio of the external additives detached from the toner is determined from a change in a weight of the toner after removing the external additives detached from the toner (see, for example, Japanese Patent No. 3129074 and Japanese Unexamined Patent Application Publication No. 2014-174341).

SUMMARY OF THE INVENTION

The present disclosure has an object to provide a toner, which does not form defective images due to filming of external additives on a photoconductor, particularly when the toner is used repetitively for a long period in a low-temperature and low-humidity, and has excellent cleaning properties.

According to one aspect of the present disclosure, a toner includes:

base particles; and external additives deposited on the base particles, wherein the toner satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the toner into a vacuumed space from an inlet, and allowing the toner to crush against a surface of a substrate having the adhesive area composed of a carbon tape, and the mica disposed in a manner that the surface is orthogonal to a direction connecting between a center of the vacuumed space and a center of the inlet, Powder particles B: particles detached from the base particles, Condition 1: when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller, Condition 2: in the number distribution D, the number of particles having particle diameters of 125 nm or smaller is 30% or less.

The present disclosure can provide a toner, which does not form defective images due to filming of external additives on a photoconductor, particularly when the toner is used repetitively for a long period in a low-temperature and low-humidity, and has excellent cleaning properties.

Figure 1:
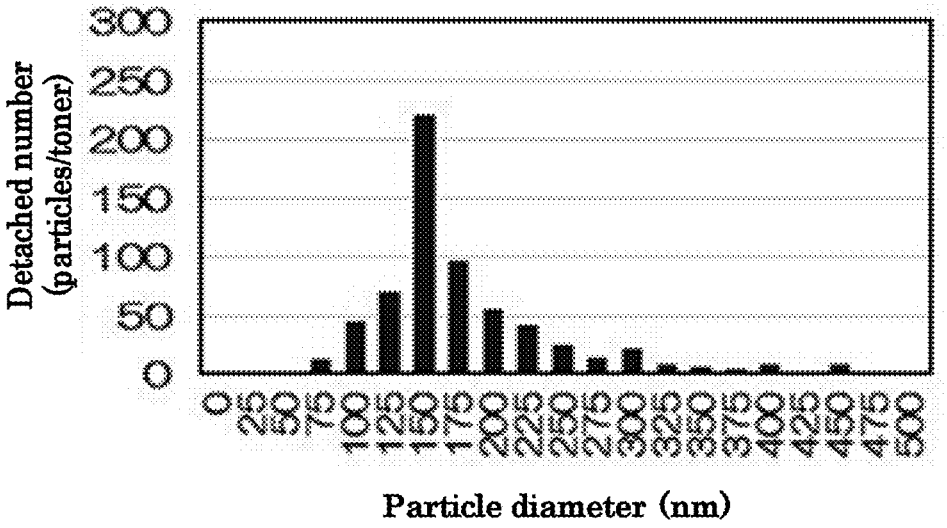
FIG. 1 is an example of a graph for determining a number distribution D.

DESCRIPTION OF THE EMBODIMENTS (Toner and Powder)

A toner of the present disclosure includes at least base particles and external additives, and may further includes other ingredients according to the necessity.

A powder of the present disclosure includes at least base particles and external additives, and may further includes other ingredients according to the necessity.

Hereinafter, the toner of the present disclosure will be described, but the descriptions also incorporate descriptions of the powder of the present disclosure by reading the "toner" as the "powder."

The wet methods disclosed in Japanese Patent No. 3129074 and Japanese Unexamined Patent Application Publication No. 2014-174341 can roughly determine easiness of detachment of external additives, but there are significant variations in measured values. Therefore, it is often difficult to determine correlation between the measured values and degrees of filming of the external additives onto a photoconductor caused by detachment of the external additives from the toner. Moreover, in what state the external additives are detached cannot be understood at all, thus it is not clear whether problems are caused by the detachment of the external additives or not. In fact, why occurrences of problems change merely by changing members, such as a carrier, a developing roller, a photoconductor, and an intermediate transfer belt, with using the same toner, cannot be explained, and images without defects cannot be obtained stably.

The present disclosure has accomplished based on the problems existing in the art.

The toner or powder satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the toner into a vacuumed space from an inlet, and allowing the toner to crush against a surface of a substrate having the adhesive area composed of a carbon tape, and the mica.

Powder particles B: particles detached from the base particles

Condition 1: when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller.

The surface of the substrate is disposed in a manner that the surface is orthogonal to a direction connecting between a center of the vacuumed space and a center of the inlet. The surface of the substrate include an adhesive area composed of a carbon tape as an area having tackiness, and an area composed of mica.

The present inventors have found that a toner satisfies the conditions above is a toner that does not cause formation of defective images due to filming of external additives on a photoconductor, particularly when the toner is repeatedly used over a long period of time in a low-temperature and low-humidity environment, and is a toner having excellent cleaning properties.

The present inventors have continued to conduct researches focusing particularly on properties of external additives based on the understanding that easiness of detachment of the external additives from a toner largely influences on occurrences of filming, and cleaning properties. As a result, the present inventors have found that the detachment of the external additives from the toner is mainly caused fundamentally when the toner is crushed against something. Moreover, it has been found that the detachment of the external additives from the toner changes depending on a hardness of a substrate against which the toner is crushed.

It is necessary to control a deposition state of external additives as a part of surface modification or a surface treatment for controlling powder movability of base particles. There is a case where the external additives needs both a function of moving with synchronizing with the base particles, and a function exhibited by detaching from the base particles at an appropriate degree. The above-mentioned functions are properties conflicting to each other. To control the properties conflicting to each other is one of important properties closely associated with movements of a toner powder particularly in an electrophotographic process. In an extreme way, it is sufficient that the external additives are completely fixed onto surfaces of the base particles, if required is simply that the external additives are synchronized, and it is sufficient that the external additives and the base particles are merely blended (including a state where the external additives are deposited or a mixture of deposition and blending) if required is easiness of detachment from the base particles.

The present inventors searched a method and means, which can control and achieve a state of a surface treatment agent (external additives) required for powder handling in a dry system of base particles (powder), and a stable state against any disturbance, stress loading, or change. As a result, a method for representing a deposition state of external additives in a dry system as a distribution has been found.

To describing through an electrophotographic process, a main mechanism in developing and transfer is that a toner and external additives are moved from a developing device to a photoconductor, the photoconductor to an optional intermediate transfer member, the photoconductor of intermediate transfer member to paper with synchronizing the toner and the external additives. Therefore, the detached external additives from the toner become a main factor for causing staining of members. Meanwhile, blade cleaning is a main stream for cleaning. However, it is necessary to have a certain amount of an accumulate layer of the external additives at a wedge of a contact point between the blade and the member when the toner particles are cleaned, and therefore an appropriate amount of the external additives needs to be supplied. Since the supplied external additives can give an adverse effect, such as staining of members, moreover, it is also necessary to consider selectivity and control of the supplied particles. Therefore, it is necessary to identify a state of the external additives whether the external additives are detached or likely detached from the base particles, and to quantify a distribution.

<Powder Particles B>

Although it depends on crushing conditions, the powder particles B are mainly the external additives detached from the base particles, with a combination of the conditions of the present disclosure and the toner.

However, it is possible that the powder particles B include fragments or powder broken from part of the base particles. Considering the number and particle diameters of these fragments or powder, the particle diameters of these fragments or powder are often largely sifted from a particle size region of the external additives. Even if the fragments or powder broken from part of the base particles are included in the powder particles B, the number of the fragments or the powder particles is extremely small, hence such the fragments or powder is unlikely affect a judgement result.

Accordingly, in the present disclosure, the powder particles B mainly indicate certain external additives fixed or deposited on surfaces of the toner base particles before supplying into the vacuumed space.

Note that, to obtain information about how many powder particles B are detached from one toner particle on average, what kind of a particle size distribution the powder particles B has, whether the powder particles B are monoparticles or aggregates, and what kind of the external additives the powder particles B include can be utilized as a development and control method to obtain preferable properties.

<Measuring Method of Number Distribution D>

The number distribution D is measured by the following method.

According to a method described in a section of <SEM observation> below, the number density of toner particles and particles detached from the toner particles in a certain region is identified from a SEM image to set the number of powder particles B per toner particle, and a particle diameter of each particle is judged by performing binarization through image analysis of the detached particles using a software installed in the device to thereby calculate the number distribution D.

The image processing is preferably performed with an image of the toner particles at the magnification of from 500 times through 5,000 times, and an image of the detached particle parts at the magnification of from 5,000 times through 30,000 times. The image can be adjusted depending on size of the particles. When the magnification is too high, however, many images need to be taken to obtain the required count number. When the magnification is too low, detection accuracy of the image analysis tends to be varied and thus it is difficult to give a judgement. The magnification of the toner image for the toner particles is more preferably from 1,000 times through 2,000 times, and the magnification of the toner image for detached particle parts is more preferably from 15,000 times through 25,000 times.

For example, 10 images of the magnification of 2,000 times are selected for toner particle analysis, and 10 images of the magnification of 2,000 times are selected for detached particle analysis, and a threshold is set to 50 nm upon image analysis, and the results are presented in a graph as illustrated in FIG. 1, by plotting particle diameters of the powder particles B on X axis, and the number (particles/toner) of the powder particles B per toner particle on Y axis.

In FIG. 1, the plot of the particle diameter, 75 nm, is cumulative data of X, 50 nm<X≤75 nm.

Moreover, the particle diameter is plotted by dividing by 25 nm, and the cumulative number of the particles having particle diameters of 500 nm or smaller is 674, and the cumulative number of the particles having particle diameters of 125 nm or smaller is 111, based on the number at each threshold.

Accordingly, the number of the particles having the particle diameters of 125 nm or smaller is 111/674×100=16.5%. Moreover, the peak top is 150 nm.

Accordingly, the number distribution D is the number distribution obtained by measuring the number of particle having particle diameters of 500 nm or smaller among the powder particles B, and determining the number of the powder particles B with dividing into ranges per 25 nm.

<Condition 1>

As a result of the researches conducted by the present inventors, the present inventors have found that prevention of a member from staining, and excellent cleaning properties are achieved when Condition 1 is satisfied.

When a proportion of the powder particles B having small particle diameters (about 125 nm or smaller) is large, staining of members, filming, and deterioration (letting the toner pass through a gap with cleaning members) of cleaning properties tend to occur.

When a proportion of the powder particles B having large particle diameters (about 200 nm or greater) is large, a polishing force generated by one particle increases, but such a force may cause a damage probably because the toner particles are roughly scraped or damaged with the particle. In addition, charge is also influenced because the external additives are repeatedly detached from and deposited onto the toner, and are transferred onto members or a carrier.

Moreover, deposition of the external additives onto members or clogging of a dead zone or a gap with the external additives tend to occur.

Examples of a method for achieving Condition 1 includes methods described below.

Properties of the toner as a powder are adjusted by controlling shapes of toner particles, and performing surface modification through addition of external additives.

As the surface modification through addition of external additives, for example, there is a method where a dispersion state and fixation degree of an external additive are adjusted. A method for adjusting the dispersion state and the fixation degree is preferably selected from methods having both practicality and productivity. In case of a polymerization toner produced by dispersing toner particle materials including external additives in an aqueous medium, an effective method is a method where hydrophobicity or pH is adjusted with adjusting a temperature of the aqueous medium to thereby fix the external additives on surfaces of toner base particles. In the case where a solvent is contained in the aqueous medium, the dispersion state and the fixation degree can be also adjusted in the same manner. Moreover, the dispersion state and the fixation degree can be adjusted by adding a dry powder to an aqueous solution or a dilute solution, but the dispersion state and the fixation degree can be more easily controlled by applying heat rather than swelling surfaces of toner base particles with the solvent.

In case of a pulverization toner produced by dry-pulverizing toner particle materials including external additives, a unit capable of adjusting a temperature may be disposed to a jacket cooling unit of a common mixer, a mixer having modified deflectors or blade shapes (e.g., super mixer, Henschel Mixer, and Q mixer) or hybridization may be used, and the fixation degree can be adjusted by adjusting shear (mechanical load) and heat or a temperature. In the case where relatively high shear is applied, however, a temperature management considering Tg of a toner or an amount of a low-melting-point material is particularly important, which tends to lead to a trade-off relationship between control of the fixation degree and productivity. Examples of a method which is a dry system, can obtain freedom of selection of a powder, and a high fixation degree, as well as obtaining high productivity include a method using a heat-treatment device utilized as a shape controlling unit. The more effective method is use of a unit configured to fix external additive by adjusting a heating temperature that does not substantially change shapes of toner particles. Such a method is more preferable because a dispersion state of particles whose fixation degree is to be adjusted by a pretreatment before a heat treatment, specifically, external additives, is appropriately set, and then the predetermined dispersion state and the high fixation degree can be obtained using the above-mentioned heat treatment device. Optionally, another treatment may be appropriately selected depending on the intended purpose, such as a treatment where the additive is further treated by a mixer, and may be performed in combination.

A range at which the number of the powder particles B has the maximum value in Condition 1 is preferably greater than 125 nm but 150 nm or less, and more preferably greater than 150 nm but 175 nm or less.

<Condition 2>

The small particle diameter (about 125 nm or smaller) component is effective in view of imparting flowability and surface coating. When a relatively large amount of particles having small particle diameters are supplied to a wedge (a layer of external additives, a packing layer) of a cleaning part, however, arrangement of particles are changed in order of the particle size at the edge portion, and the particles are even more packed. As the particle size of the particles of the external additives decreases, the external additives tend to cause filming, staining of members, and passing through a blade at the wedge edge area. Moreover, the passing through of the external additives tends to occur even more when influences of input (a toner etc.) to the cleaning blade or external inputs (so-called noise, disturbance factors, vibrations, distortion, and rotation). Moreover, the small particles tend to go into minute irregular textures, such as minute irregular-textured damages. Moreover, filming, scratches, and adherence are accelerated by load of the cleaning blade applied during the external additives are passed through a gap with the cleaning blade. Accordingly, an amount of the external additives for adding is preferably controlled within a necessary range, as much as possible.

Considering the view point as mentioned above, Condition 2 is satisfied in the present disclosure.

Note that, the particle diameters of the powder particles B include, not only particle diameters of primary particles, but also particle diameters of secondary particles (aggregates). Accordingly, in the number distribution D of the powder particles B, a secondary particle is also counted as one particle.

When Condition 2 is determined, it is no problem to quantify 25 nm (greater than 0 nm but 25 nm or less) and 50 nm (greater than 25 nm but 50 nm or less), if it can be distinguished on image analysis. However, it is often difficult to secure detection accuracy and an area, and distinguish from foreign matter, and a lot of noise is included. Therefore, it is preferable to define with 66 nm or greater.

Specifically, in the present disclosure, a detection count T in Condition 2 is determined as 30% or less with 66 nm$<T\leq$125 nm.

The number in Condition 2 is 30% or less. The number is preferably from 3% through 25%, and more preferably from 3% through 20% in view of both cleaning properties and anti-filming properties.

<Vacuum Dispersion Particle Image Analysis>

A method for crushing the toner or powder against a surface of a substrate in an evaluation method of the toner or powder of the present disclosure is described with reference to FIGS. 2A to 2E.

Figure 2A:
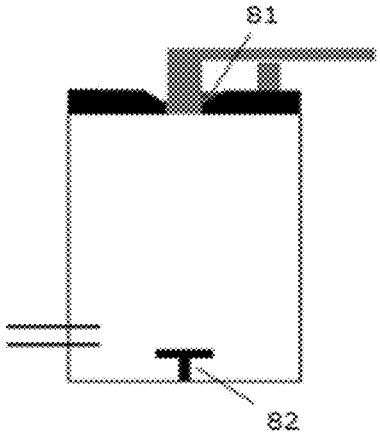
FIG. 2A is an example view for explaining vacuum dispersion particle image analysis where a toner is crashed against a substrate.
Figure 2B:
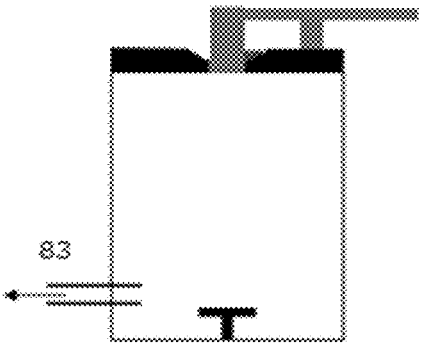
FIG. 2B is an example view for explaining vacuum dispersion particle image analysis where a toner is crashed against a substrate.
Figure 2C:
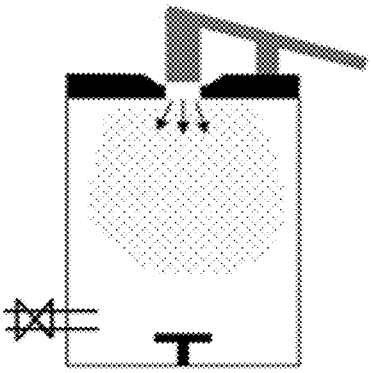
FIG. 2C is an example view for explaining vacuum dispersion particle image analysis where a toner is crashed against a substrate.
Figure 2D:
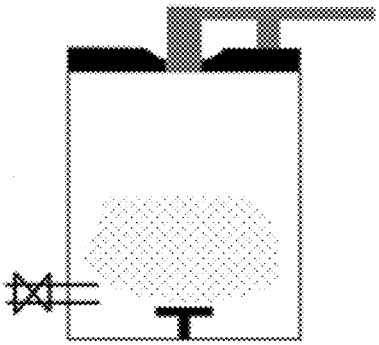
FIG. 2D is an example view for explaining vacuum dispersion particle image analysis where a toner is crashed against a substrate.
Figure 2E:
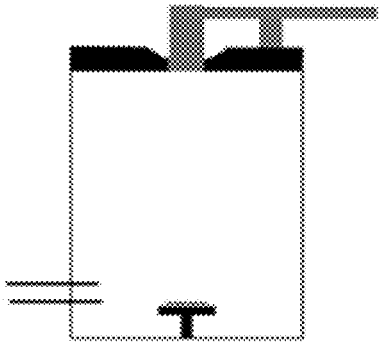
FIG. 2E is an example view for explaining vacuum dispersion particle image analysis where a toner is crashed against a substrate.

A toner sample 81 is placed at the top of a disperser (see FIG. 2A), and the internal pressure of the disperser is reduced to 10 kPa by a vacuum pump 83 (see FIG. 2B). Thereafter, a gap is formed at the top of the disperser for a short period of time (about 0.1 seconds) to suction the toner sample 81 into the disperser (see FIG. 2C). After leaving to stand for 1 minute (see FIG. 2D), the internal pressure of the disperser is returned back to ordinary pressure (see FIG. 2E), and a substrate (pin stub) 82 is taken out.

When the toner of the present disclosure is evaluated, the toner is introduced from the top of the disperser together with an extremely small amount of air. Since the inside of the disperser is a vacuumed space, air resistance inside the disperser is extremely small. Therefore, the toner introduced from the top of the disperser is linearly crushed into the substrate at high speed.

On the substrate to which the toner is crushed, at least one or more areas having tackiness, and at least one or more areas harder than the area having tackiness are dispersed. The toner is captured by the area having tackiness. When the toner is crushed on the area having tackiness, particles (external additives) may be detached from the base particles of the toner, but the base particles of the toner are deposited on the area having tackiness. Accordingly, a material of the area having tackiness is not particularly limited, and may be appropriately selected depending on the intended purpose, as long as the material is a material to which base particles of the toner can be surely deposited. Considering that observation under a scanning electron microscope (SEM) is performed, the material is preferably a carbon tape for SEM observation, which releases less gas, and surely captures base particles.

Since the area harder than the area having tackiness does not have tackiness, most of base particles of the toner is not fixed on the area harder than the area having tackiness. However, particles (external additives) deposited on the base particles of the toner may remain on the harder area with electrostatic force or intermolecular force because of the small size of the particles. A material of the area harder than the area having tackiness is appropriately selected from materials used in an area to which a toner may be crushed inside an image forming apparatus. The material is preferably mica.

As a toner sample for supplying to a disperser when the toner is evaluated, a toner having particle diameters of 0.5 μm through 200 μm may be used. Moreover, the number average particle diameter is preferably from 1 μm through 100 μm and more preferably from 2 μm through 50 μm. When the number average particle diameter of the toner sample supplying to the disperser is within the above-mentioned range, an accurate measuring result can be obtained upon evaluating filming of external additives.

As the vacuumed space used in the evaluation method of the toner of the present disclosure, an internal diameter of the disperser is preferably from 50 mm through 200 mm, and more preferably from 70 mm through 150 mm, in view of pressure resistance and spreading of particles to be supplied. A height of the vacuumed space is preferably from 75 mm through 300 mm, and more preferably from 100 mm through 260 mm. When the height of the vacuumed space is 75 mm or greater, the particles can be uniformly dispersed. When the height of the vacuumed space is 260 mm or less, the space can be vacuumed within a short period of time, and it is not necessary to use a large scale vacuum pump.

A degree of vacuum of the vacuumed space for use in the evaluation method of the toner of the present disclosure is preferably 20 kPa or less, and more preferably from 5 kPa through 15 kPa. When the degree of vacuum of the vacuumed space is 20 kPa or less, a problem that the toner particles supplied into the vacuumed space receive air resistance to weaken the energy for crushing into a substrate can be prevented.

The disperser used for evaluating the toner of the present disclosure is preferably a disperser NEBULA 1 (available from Phenom-World), because handling and reproducibility of dispersion are excellent.

A concentration (a (particles/mm$^2$)) of toner particles of the toner crushed against the substrate per unit area can be determined with the number of the toner base particles deposited on the area having tackiness. Even if the external additives are detached from the toner deposited on the area having tackiness, the number average particle diameter of the external additives is significantly smaller than the toner as described above. Therefore, only the toner can be distinguished from a size of the detected particles.

Moreover, the number b/a of the external additive particles detached from one toner particle is calculated from a concentration (b (particles/mm$^2$)) of the external additives deposited on the area harder than the area having tackiness, and the desirability of the toner can be judged with the value of b/a.

It is difficult to measure the number of particles of the toner and particles of the external additives on the area having tackiness and the area harder than the area having tackiness using optical measure, and therefore the measurement is performed by means of a scanning electron microscope (SEM).

Shapes of individual external additive particles can be observed under SEM, particle size parameters, such as circularity, irregularity, and an aspect ratio, can be determined by SEM, as well as particle diameters of the external additives.

In the present disclosure, an area having tackiness is determined a carbon tape, and an area harder than the carbon tape is determined as mica.

Specifically, a carbon double-sided tape for SEM E3605 (available from EM Japan Co., Ltd.) is bonded onto a surface of an aluminium pin stub (available from EM Japan Co., Ltd.) having a diameter of 25 mm and a pin of 8 mm, and mica stamped into a diameter of 10 mm is bonded onto the pin stub with the tape.

The pin stub is placed inside a disperser NEBULA 1 (available from Phenom-World), and the toner is placed at a sample inlet of the disperser. After reducing the pressure inside the disperser to 10 kPa, the sample inlet having a diameter of 25 mm is open for about 0.1 seconds, and the toner is introduced inside the disperser. As a result of the introduction of the toner sample, the pressure inside the disperser increases to 20 kPa. Note that, the toner is crushed into the substrate of the pin stub with the air flow of about 7.3 m/sec. The pressure is maintained for 1 minute, and the pressure inside the disperser is returned to ordinary pressure, and the pin stub is taken out. When the pressure inside the disperser is returned to ordinary pressure, air is introduced into the disperser at the rate of about 10 kPa/5 sec.

Particle diameters of the powder particles B on the carbon tape and mica on the surface of the pin stub are observed under a desktop SEM proX PREMIUM (available from PHENOM-WORLD), and a measurement of a particle size distribution is performed by means of particle metric software (available from PHENOM-WORLD). The measurement result is recorded.

<SEM Observation>

Figure 3:
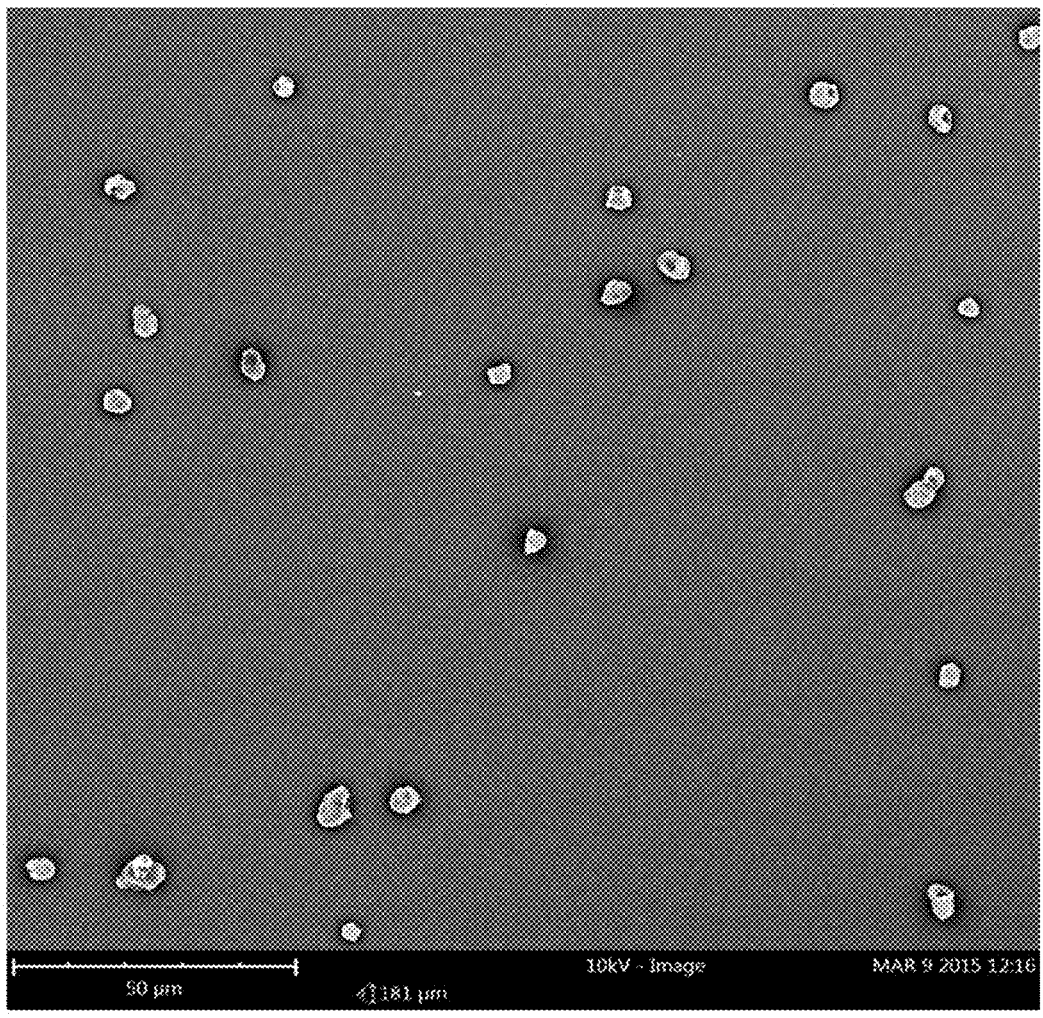
FIG. 3 is a view illustrating one example of a scanning electron microscope (SEM) image of a toner on a carbon tape.

The SEM observation of the toner on the carbon tape is performed by taking SEM photographs randomly at 10 positions in a field of view of 181 μm-side square. One of the SEM photographs taken with field view of 181 μm-side square is depicted in FIG. 3. Only toner particles are observed on the carbon tape, and detachment of external additives cannot be observed at all.

A total number of the toner particles in the SEM photographs taken at the 10 positions are measured by means of particle metric software. As a result, the toner particles are present at a concentration of 586 particles/mm$^2$.

Figure 4:
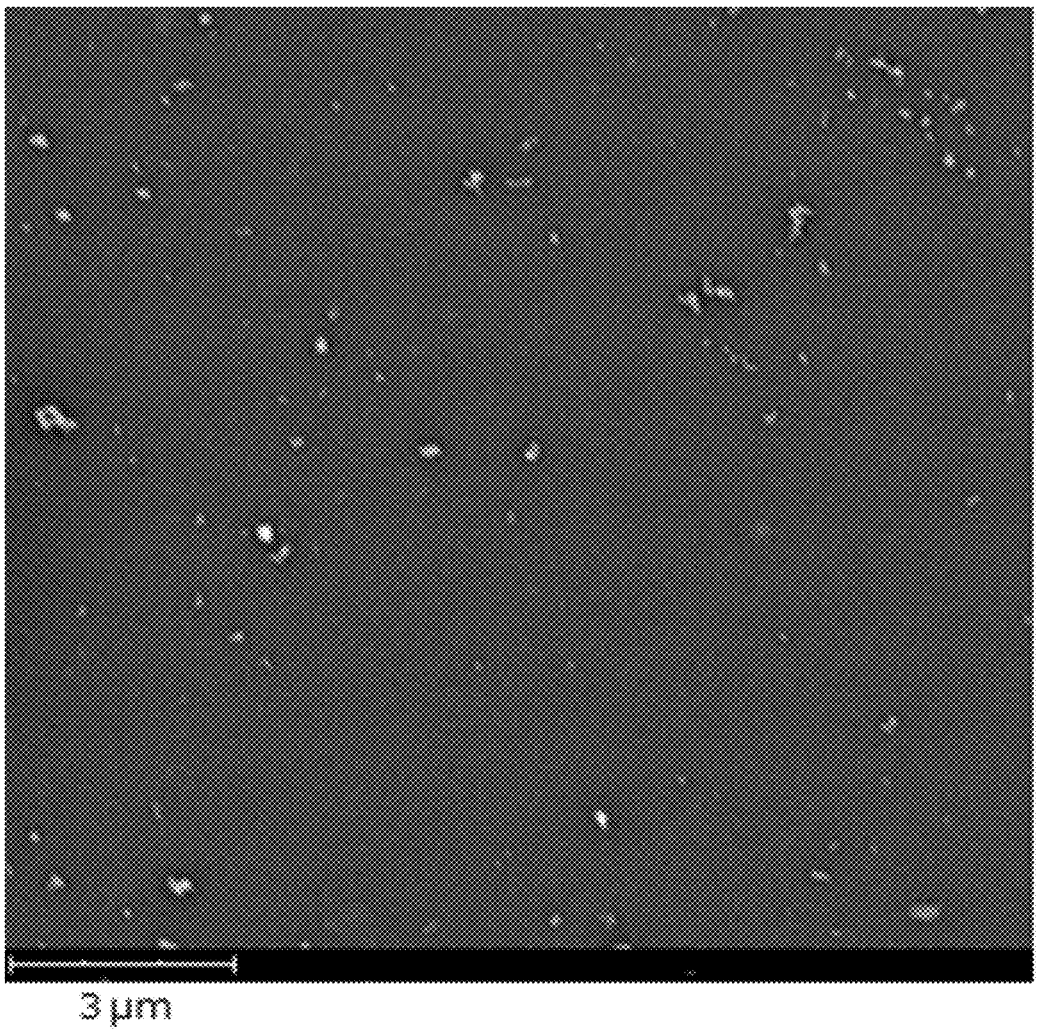
FIG. 4 is a view illustrating one example of a scanning electron microscope (SEM) image of a toner on mica.

Similarly, SEM photographs are taken at 10 positions on the mica in a field of view of 13.5 μm-side square. The SEM photographs are randomly taken, but an area where there is no toner in the SEM photograph is selected and taken. One example of the SEM photograph on the mica is depicted in FIG. 4.

The large number of the external additive particles are observed on the mica. A total number of the external additive particles in the SEM photographs taken at the 10 positions is measured by the particle metric software, and it is found that the external additives are present at a concentration of 847,736 particles/$mm^2$.

As a result, it is found in case of the toner that 1,446 particles of the external additives are detached from 1 particle of the toner.

The detachment of the external additives occur the most at the area where the toner is crashed into the mica, but the mica plate is damaged by the impact of the crash and it is difficult to distinguish between the detached external additives and the fragments of the mica come off from the mica plate. Moreover, the toner itself generates fragments, and it is difficult to distinguish between the detached external additives and the toner fragments. Therefore, a SEM image is taken by excluding an area to which the toner is crashed.

A density a of toner particles per unit area of the substrate to which the toner is crushed is preferably from 300 particles/$mm^2$ through 1,200 particles/$mm^2$, and more preferably from 500 particles/$mm^2$ through 1,200 particles/$mm^2$. When the density of the toner at the time of dispersing the toner is from 300 particles/$mm^2$ through 1,200 particles/$mm^2$, the following problems can be prevented.

- A problem that the number of external additive particles detached is small because a region where the toner is not dispersed is too large.
- A problem that it is difficult to take a SEM image excluding an area to which the toner is crashed.

The number of the detached external additive (powder particles B) on the mica is preferably from 200 particles through 1,800 particles, more preferably from 200 particles through 1,500 particles, and even more preferably from 300 particles through 1,200 particles, per toner particle. When the number of the detached external additive on the mica per toner particle is from 200 particles through 1,800 particles, the following problems can be prevented.

- A problem that embedding of inorganic particles (powder particles B) onto toner base particles become significant, and aggregation of toner particles occur to form black spots in an image to generate image density unevenness.
- A problem that filming to a photoconductor becomes significant, and a white-missing image is formed due to the filmed area.

<Base Particles>

The base particles include, for example, a binder resin, and may further include other ingredients, such as a colorant, a release agent, and a charge-controlling agent, according to the necessity.

<<Binder Resin>>

The binder resin is not particularly limited, and may be appropriately selected depending on the intended purpose. Examples of the binder resin include styrene-based resins (homopolymers or copolymers including styrene or styrene substitution products), vinyl chloride resins, styrene-vinyl acetate copolymers, rosin-modified maleic acid resins, phenol resins, epoxy resins, polyethylene resins, polypropylene resins, ionomer resins, polyurethane resins, silicone resins, ketone resins, ethylene-ethyl acrylate copolymers, xylene resins, polyvinyl butyral resins, petroleum-based resins, and hydrogenated petroleum-based resins.

Examples of the styrene-based resins (homopolymers or copolymers including styrene or styrene substitution products) include polystyrene, polychlorostyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic acid ester copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylic acid ester copolymers (e.g., styrene-methyl methacrylate copolymers, styrene-ethyl methacrylate copolymers, styrene-butyl methacrylate copolymers, and styrene-phenyl methacrylate copolymers), styrene-methyl α-chloroacrylate copolymers, and styrene-acrylonitrile-acrylic acid ester copolymers.

A production method of any of the above-listed resins is not particularly limited, and may be appropriately selected. For example, bulk polymerization, solution polymerization, emulsion polymerization, or suspension polymerization can be used as the production method.

Not only single use, two or more of the above-listed resins may be used in combination.

The binder resin for use in the present disclosure is more preferably a polyester resin in view of low temperature fixability. For example, polyester resins typically obtained by condensation polymerization of an alcohol component and a carboxylic acid component can be used as the polyester resin.

Examples of the alcohol component include: glycols; 1,4-bis(hydroxymethyl)cyclohexane; ethylated bisphenols, such as bisphenol A; other bivalent alcohol monomers, and trivalent or higher polyvalent alcohol monomers.

Examples of the glycols include ethylene glycol, diethylene glycol, triethylene glycol, and propylene glycol.

Moreover, examples of the carboxylic acid component include bivalent organic acid monomers and trivalent or higher polyvalent carboxylic acid monomers.

Examples of the bivalent organic acid monomers include maleic acid, fumaric acid, phthalic acid, isophthalic acid, terephthalic acid, succinic acid, and malonic acid.

Examples of the trivalent or higher polyvalent carboxylic acid monomers include 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

As the polyester resin, particularly, a polyester resin having glass transition temperature (Tg) of 55° C. or higher is preferable, and a polyester resin having Tg of 60° C. or higher is more preferable, in view of heat resistant storage stability.

A DSC measurement (for endothermic peaks or glass transition temperature Tg) performed in the present disclosure is performed by means of a differential scanning calorimeter (DSC-60, available from Shimadzu Corporation) by heating a temperature from 20° C. through 150° C. at a rate of 10° C./min.

—Crystalline Polyester Resin Used in Combination—

When the binder resin includes crystalline polyester, low temperature fixability and heat resistant storage stability can be imparted to toner owing to sharp-melting properties of the crystalline polyester.

The crystalline polyester resin means a polyester resin, which has a particularly large proportion of a crystalline structure where a principle chain is regularly orientated, and which changes a viscosity at a temperature around a melting point of the resin.

The crystalline polyester resin is preferably a crystalline polyester resin synthesized with, for example, as an alcohol component, a saturated aliphatic diol compound having from 2 through 12 carbon atoms (particularly, 1,4-butanediol, 1,6-hexanediol, 1,8-octanediol, 1,10-decanediol, 1,12-dodecanediol, and derivatives of the foregoing diol compounds), and at least, as an acid component, dicarboxylic acid having a double bond (C=C bond) and having from 2 through 12 carbon atoms, or saturated dicarboxylic acid having from 2 through 12 carbon atoms (particularly, fumaric acid, 1,4-butanedioic acid, 1,6-hexanedioic acid, 1,8-octanedioic acid, 1,10-decanedioic acid, 1,12-dodecanedioic acid, and derivatives of the foregoing dicarboxylic acids).

Among the above-listed examples, the crystalline polyester resin composed of an alcohol component that is, particularly, selected from the group consisting of 1,4-butanediol, 1,6-hexanediol, 1,8-octanediol, 1,10-decanediol, or 1,12-dodecanediol, and a dicarboxylic acid component that is fumaric acid, 1,4-butanedioic acid, 1,6-hexanedioic acid, 1,8-octanedioic acid, 1,10-decanedioic acid, and 1,12-dodecanedioic acid in order to minimize a difference between an endothermic peak temperature and an endothermic shoulder temperature.

A molecular structure of the crystalline polyester resin can be confirmed by a solution or solid NMR measurement, X-ray diffraction, GC/MS, LC/MS, or IR absorption spectroscopy.

<<<Colorant>>>

As a colorant for use in the toner of the present disclosure, for example, dyes or pigments known in the art, such as carbon black, lamp black, iron black, aniline blue, phthalocyanine blue, phthalocyanine green, Hansa yellow G, Rhodamine 6C lake, calco oil blue, chrome yellow, quinacridone, bendizine yellow, rose bengal, triallyl methane-based dyes, can be used. The above-listed colorants may be used alone or as a mixture, and can be used as a black toner or full color toners.

An amount of the colorant is preferably from 1% by mass through 30% by mass and more preferably from 3% by mass through 20% by mass, relative to the binder resin of the toner.

<<<Release Agent>>>

As the release agent, any of release agents known in the art can be used. Examples of the release agent include: low-molecular-weight polyolefin wax, such as low-molecular-weight polyethylene and low-molecular-weight polypropylene; synthetic hydrocarbon-based wax, such as Fischer-Tropsch wax; natural wax, such as bees wax, carnauba wax, candelilla wax, rice wax, and montan wax; petroleum wax, such as paraffin wax and microcrystalline wax; higher fatty acids, such as stearic acid, palmitic acid, and myristic acid; metal salts of the higher fatty acids; higher fatty acid amides; synthetic ester wax; and various modified wax of the above-listed wax.

Among the above-listed examples, carnauba wax, modified carnauba wax, polyethylene wax, and synthetic ester wax are preferably used.

The above-listed release agents may be used alone or in combination.

Moreover, an amount of any of the release agents for use is preferably from 2% by mass through 15% by mass and more preferably from 2.5% by mass through 10% by mass relative to the binder resin of the toner. When the amount is 2% by mass or greater, an anti-hot offset effect is exhibited. When the amount is 15% by mass or less, deterioration in transfer properties and durability of a resultant toner can be prevented.

A melting point of the release agent is preferably from 60° C. through 150° C. and more preferably from 65° C. through 120° C. When the melting point is 60° C. or higher, a resultant toner is prevented from having poor heat resistant storage stability. When the melting point is 150° C. or lower, a mold release effect can be exhibited.

<<<Charge-controlling Agent>>>

A charge-controlling agent may be blended in the base particles, according to the necessity.

Examples of the charge-controlling agent include: nigrosine and modified products (fatty acid metal salt-modified) of nigrosine; onium salts (e.g., phosphonium salt) and lake pigments of onium salts; triphenyl methane dyes and lake pigments of triphenyl methane dyes; metal salts of higher fatty acids; diorgano tin oxide, such as bibutyl tin oxide, dioctyl tin oxide, and dicyclohexyl tin oxide; diorgano tin borate, such as dibutyl tin borate, dioctyl tin borate, and dicyclohexyl tin borate; organic metal complexes; chelate compounds; monoazo metal complexes; acetyl acetone metal complexes; aromatic hydroxycarboxylic acids; aromatic dicarboxylic acid-based metal complexes; quaternary ammonium salts; and salicylic acid metal compounds. Other examples are aromatic hydroxycarboxylic acid, aromatic mono- or polycarboxylic acid and metal salts anhydrides, esters, or phenol derivatives (e.g. bisphenol) of aromatic mono- or polycarboxylic acid. Any of the above-listed charge-controlling agents (polarity-controlling agents) may be used alone or in combination as the charge-controlling agent.

An amount of the charge-controlling agent is from 0.1% by mass through 10% by mass and preferably from 1% by mass through 5% by mass relative to an amount of the binder resin of the toner.

<External Additives>

In the present disclosure, at least two or more types of external additives are preferably used. In the present specification, different types of the external additives means that external additives have different number average particle diameters of primary particles or different materials. External additives having large particle sizes function as a spacer for preventing contact between the toner and members of an image forming apparatus, and external additives having small particle sizes impart the toner flowability. As the particle diameters of the external additives increase, it is easier to detach from the toner. Particles used for the external additives may be inorganic particles or organic particles.

An amount of the external additives contained in the toner as a total value of a plurality of the external additives is preferably from 0.5% by mass through 3.5% by mass relative to an amount of the base particles.

Moreover, a number average particle diameter of the external additives is more preferably from 0.01 μm through 0.6 μm and even more preferably from 0.05 μm through 0.4 μm.

<<Inorganic Particles>>

The inorganic particles are not particularly limited, and may be appropriately selected depending on the intended purpose. Examples of the inorganic particles include silica, alumina, titania (titanium oxide), barium titanate, magnesium titanate, calcium titanate, strontium titanate, fluorine compounds, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

<<Organic Particles>>

Examples of the organic particles include: polymers of styrene and substituted products of styrene, such as polystyrene, poly-p-chlorostyrene, and polyvinyl toluene; styrene-based copolymers, such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers, and styrene-maleic acid ester copolymers; polymethyl methacrylate; polybutyl methacrylate; polyvinyl chloride; polyvinyl acetate; polyethylene; polypropylene; polyester; epoxy resins; epoxy polyol resins; polyurethane; polyamide; polyvinyl butyral; polyacrylic acid resins; rosin; modified rosin; terpene resins; aliphatic or alicyclic hydrocarbon resins; aromatic petroleum resins; chlorinated paraffin; and paraffin wax. The above-listed examples may be used alone or as a mixture.

Among the above-listed examples, the external additives preferably include at least one selected from the group consisting of silica, titania, alumina, a fluorine compound, and resin particles, because use of such materials as the external additives can impart excellent flowability.

Examples of the fluorine compound include PTFE particles. The PTFE particles are not particularly limited, but preferably low-molecular weight PTFE particles. Examples of a commercial product of the PTFE particles include "KTL-500F" (available from KITAMURA LIMITED, average particle diameter: 0.5 μm), "RUBURON L2" (available from DAIKIN INDUSTRIES LIMITED, average particle diameter: 300 nm), "RUBURON L5, L5F" (available from DAIKIN INDUSTRIES LIMITED, average particle diameter: 200 nm), TLP10E-1 (available from Du Pont-Mitsui Fluorochemicals Company, Ltd.), and Fluon PTFE lubricant-169J, L170J, and L173J (available from ASAHI GLASS CO., LTD.).

Examples of the silica particles include dry silica or fumed silica generated by gas-phase oxidation of a silicon halogenated product, wet silica produced from water glass, and sol-gel silica produced by a sol-gel method. The external additive is preferably dry silica having less silanol groups on surfaces of or inside silica particles, and less $Na_2O$ and $SO_3^{2-}$. Moreover, the dry silica may be composite particles of silica and another metal produced by using a metal halogen compound, such as aluminium chloride, and titanium chloride, and a silicon halogen compound together in a production process.

Surfaces of particles of the external additives are preferably subjected to a hydrophobic treatment in view of adjustment of a charging amount of the toner, improvement of environmental stability, and improvement of properties in a high-humidity environment. When the external additives added to the toner absorb moisture, a charging amount of the toner is lowered, a developing performance or transfer performance tends to be deteriorated, and durability tends to be deteriorated.

Examples of a hydrophobic treatment method of the external additives include a method for chemically treating an organic silicon compound that reacts or physically adsorb the particles. In the present disclosure, moreover, inorganic particles, which have been or have not been subjected to a hydrophobic treatment, may be treated with silicone oil.

Examples of a hydrophobic treatment agent used for a surface treatment include unmodified silicone varnish, various modified silicone varnish, unmodified silicone oil, various modified silicone oil, silane compounds, silane coupling agents, other organic silicon compounds, and organic titanium compounds. The above-listed treatment agents may be used alone or in combination.

A preferable example of a treatment of silica particles preferably used for the toner of the present disclosure is described.

In the present disclosure, the silica particles are preferably silica particles treated with a silane or silazane compound after treating raw material silica particles with silicone oil. As a result of the above-described treatment, a transfer performance, charging stability in a high-temperature and high-humidity environment, and flowability after storing at high temperature can be achieved at high level.

Moreover, the silica particles are more preferably silica particles obtained by treating raw material silica particles with silicone oil, followed by performing a grinding treatment. The flowability of the toner is enhanced by performing the grinding treatment.

In the present disclosure, moreover, an amount of silicone oil extracted from the silica particles, which have been subjected to a surface treatment with silicone oil, using hexane is preferably 0.50% by mass or less, and more preferably 0.10% by mass or less. When the amount of the silicone oil extracted is within the above-mentioned range, reduction in an amount of detached oil during storage at a high temperature can be expected, excellent flowability is obtained even after storage at a high temperature, and excellent trackability of solid images are obtained.

Note that, the amount of the extracted silicone oil can be appropriately controlled depending on a processing amount and processing temperature when raw material silica particles are treated with silicone oil.

Moreover, a hydrophobic rate of the silica particles in the present disclosure is preferably 95% or greater but 100% or less, and more preferably 97% or greater but 100% or less. In the case where the hydrophobic rate of the silica particles is 95% or greater, charging stability during storage in a high-temperature and high-humidity environment is improved even further. The hydrophobic rate of the silica particles can be controlled with a treatment amount and treatment conditions of a silane or silazane compound.

Silicone oil used for a treatment of the silica particles for use in the present disclosure is not particularly limited, and silicone oil known in the art can be used. The silicone oil for use is particularly preferably straight silicone oil.

Specific examples of the silicone oil include dimethyl silicone oil, alkyl-modified silicone oil, α-methyl styrene-modified silicone oil, fluorine-modified silicone oil, and methyl hydrogen silicone oil.

As a method for a silicone oil treatment, for example, silica particles and silicone oil may be directly mixed by means of a mixer, such as HENSCHEL MIXER, or stirring may be performed on raw material silica particles with spraying silicone oil. Alternatively, silicone oil is dissolved or dispersed in an appropriate solvent (preferably, pH of which is adjusted to 4 with organic acid), and the dispersion liquid or solution is then mixed with raw material silica particles, followed by removing the solvent. Moreover, the method may be a method where raw material silica particles are placed in a reaction tank, alcohol water is added with stirring under a nitrogen atmosphere, and a silicone oil-based treatment liquid is introduced into the reaction tank to perform a surface treatment, followed by heating and stirring to remove the solvent.

A silane or silazane compound used for a treatment of the silica particles in the present disclosure is not particularly limited, and silane or silazane compounds known in the art can be used.

Specific examples of the silane or silazane compound include hexamethyl disilazane, trimethyl silane, trimethyl chlorosilane, trimethyl ethoxysilane, dimethyl dichlorosilane, methyl trichlorosilane, allyl dimethyl chlorosilane, allyl phenyl dichlorosilane, benzyl dimethyl chlorosilane, bromomethyldimethyl chlorosilane, α-chloroethyl trichlorosilane, β-chloroethyl trichlorosilane, chloromethyklimethyl chlorosilane, triorganosilyl mercaptan, trimethylsilyl mercaptan, triorganosilyl acrylate, vinyl dimethyl acetoxy silane, dimethyl ethoxy silane, dimethyl dimethoxy silane, and diphenyl diethoxy silane. Among the above-listed examples, hexamethyl disilazane is preferably used in view of uniformity of a treatment and reliability of coupling bonds. The silane or silazane compound may be used alone, or in combination of two or more.

A treatment with at least one of a silane compound or a silazane compound to obtain the silica particles for use in the present disclosure may be a treatment performed according to methods commonly known, such as a dry treatment where raw material silica particles formed into a cloud state by stirring are allowed to react with a vaporized silane or silazane compound, and a wet method where raw material silica particles are dispersed in a solvent, and a silane or silazane compound is dropped to react with the silica particles.

In the case where a treatment is performed with a silane compound or a silazane compound in the present disclosure, a total amount of the silane compound or silazane compound for use is 1 part by mass or greater but 50 parts by mass or less relative to 100 parts by mass of the raw material silica particles.

A hydrophobic treatment may be performed on inorganic particles in the same manner as the method described above by replacing the silica particles with the inorganic particles.

A number average particle diameter of the external additives is preferably 1/5 or less the number average particle diameter of the base particles, and more preferably 1/10 or less.

In the present disclosure, a plurality of the external additives is preferably added. In addition to an external additive having a number average particle diameter of from 50 nm through 200 nm, an external additive having a number average particle diameter of from 2 nm through 30 nm is preferably added, and an external additive having a number average particle diameter of from 2 nm through 20 nm is more preferably added. The external additive having a large particle size functions as a spacer for preventing contact between the toner. The external additive having a small particle size imparts the toner flowability. Note that, the number average particle diameter of the external additive means an average primary particle diameter, not an average particle diameter of particles in the aggregated state.

The external additive having a number average particle diameter of from 2 nm through 30 nm is preferable because such the external additive is easily dispersed with or fixed on toner base particles, is effective for covering surfaces of the toner base particles, and tends to impart flowability to the toner. When the number average particle diameter of the external additive is 2 nm or greater, excellent flowability is obtained. When the number average particle diameter of the external additive is 30 nm or smaller, a problem that the external additive is deposited onto surface of the toner base particles to reduce the contact area and hence a function of flowability cannot be sufficiently exhibited can be effectively prevented.

On the other hand, embedding of external additives onto toner base particles tend to occur over time by stress applied through a developing process. As a result, a non-electrostatic adhesion force of the toner particles increases, and therefore filming to a photoconductor tends to occur. Moreover, a friction force between the toner particles tends to decrease, and therefore toner scattering or toner packing (press or standing) tends to occur.

Therefore, use of an external additive of from 50 nm through 200 nm in combination can reduce embedding of the external additive of a small particle size, and can improve transfer properties of the toner, or adjust to increase a friction force (reducing flowability) between powder particles by reducing contact points or a contact area with a member owing to a spacer effect, or can adjust to reduce packing. Accordingly, use of such an external additive in combination optionally with adjustments is preferable.

—Measurement of Particle Diameter of External Additive—

In the present disclosure, particle diameter of external additives can be measured in the following manner. The external additive is observed under TEM (transmission electron microscope, H-9000NAR, available from Hitachi, Ltd.), and 100 particles of the external additive are randomly selected and particle diameters of the 100 particles are calculated by image-processing software (image analyzer Luzex AP, available from NIRECO CORPORATION) to determine a number average particle diameter.

<Properties of Toner and Powder>

<<Average Particle Diameter of Toner and Powder>>

A number average particle diameter of the toner or powder of the present disclosure is preferably 3.0 μm or greater.

In order to obtain high quality images having excellent thin-line reproducibility, a number volume average particle of the toner or powder is more preferably from 4.0 μm through 10 μm.

When the number average particle diameter is 3.0 μm or greater, an image quality can be excellently maintained without adversely affecting cleaning performance in a developing step and transfer efficiency in a transferring step. When the number average particle diameter is 10 μm or smaller, thin-line reproducibility of an image can be excellently maintained.

—Number Average Particle Diameter of Toner and Powder—

A measurement of the number volume average particle diameter of the toner or powder can be performed by various methods. For example, Coulter Multisizer III available from Beckman Coulter, Inc.

<<Average Circularity>>

Within the toner or powder of the present disclosure, an average circularity of particles having diameters of 3.0 μm or greater is preferably from 0.910 through 0.975 in view of the following points.

When shapes of particles are excessively irregular, variations in contact points and contact areas increase, and hence movements of the powder largely vary, or selectivity of particles increases. Accordingly, uniformity tends to be impaired, and moving disorder tends to occur when the particles are packed, in view of handling of the powder in contact with the member. When the shapes of the particles are too close to spheres, flowability becomes excessively high and thus it is difficult to control handling of the powder due to a flashing phenomenon, a contact area increases with a relation with a roughness of a member, or cleaning failures may occur due to slip of the toner particles inside the device.

—Average Circularity—

The average circularity can be measured by means of a flow-type particle measuring analyzer FPIA-3000 (available from Sysmex Corporation). A specific measuring method of the average circularity is as follows. As a dispersant, 0.1 mL through 0.5 mL of a surfactant, preferably alkyl benzene sulfonic acid salt is added to 100 mL through 150 mL of water from which impurity solids in a container have been removed in advance, followed by further adding about 0.1 g through about 0.5 g of a measurement sample. The suspension liquid, in which the sample has been dispersed, is subjected to a dispersion treatment for about 1 minute through about 3 minutes by an ultrasonic disperser to adjust a concentration of the dispersion liquid to from 3,000 particles/μL through 10,000 particles/μL. Shapes of particles of the toner and size distribution of the particles of the toner can be measured from the dispersion liquid by means of the above-mentioned device.

The average circularity of the particles having diameters of 3.0 μm or greater is an average circularity obtained with the following setting of the analysis conditions after the measurement:

Particle Diameter Limit:

$$3.033 \leq \text{circle equivalent diameter(number basis)} < 400$$

<<Ru Dying>>

When cross-sections of the toner or powder dyed with Ru are observed, the toner or powder has a shell structure having a different composition observed with a difference in contrast, and an average thickness of the shell structure is preferably from 1/60 through 1/10 relative to a diameter of the base particle of the toner or powder.

When the toner base particles having diameters of 6 μm are dyed with Ru, for example, a shell layer having a different contrast is observed at a surface of the base particle with an average thickness of from 100 nm through 600 nm.

Specifically, an average thickness of the shell structure can be measured in the following manner.

After embedding a toner in an epoxy-based resin and curing the epoxy-based resin, the cured resin was cut by a knife to expose cross-sections of the toner. An ultrathin cut piece of the toner having a thickness of 80 nm is produced by means of an ultramicrotome ULTRACUT UCT (available from Leica-Camera AG). Next, the ultrathin cut piece is exposed to gas including ruthenium tetraoxide for 5 minutes to dye and identify shells and cores. Moreover, the ultrathin cut piece of the toner is observed by means of transmission electron microscope (TEM) H7000 (available from Hitachi High-Technologies Corporation) at accelerating voltage of 100 kV, to measure a thickness of the shell. The thickness of shells of 10 toner particles are measured, and an average value is calculated.

<Production Method of Toner and Powder>

The toner and powder of the present disclosure can be obtained by externally adding the external additives to the base particles.

The base particles can be obtained by various production methods, such as grinding methods and polymerization methods (e.g., suspension polymerization, emulsion polymerization, dispersion polymerization, emulsification aggregation, and emulsion coagulation).

In order to output images of high image quality and high resolution, the toner of the present disclosure is preferably a toner having small particle diameters and particles close to spheres. Therefore, a production method of the toner is preferably suspension polymerization, emulsion polymerization, or polymer suspension, in all of which an oil phase is emulsified, suspended, or aggregated in an aqueous medium to form toner base particles.

<<Suspension Polymerization>>

A colorant, a release agent, and a charge-controlling agent are disposed in an oil-soluble polymerization initiator and a polymerizable monomer, and a resultant is emulsified and dispersed in an aqueous medium including a surfactant, and other solid dispersants according to an emulsification method. At the time of emulsification and dispersion, particle diameters of the release agent are controlled by conditions, such as stirring speed for dispersing the release agent, and a temperature. Thereafter, the resultant is allowed to perform a polymerization reaction to form particles, followed by performing a wet treatment where inorganic particles are deposited on surfaces of the base particles for use in the present disclosure. At the time of the wet treatment, the wet treatment is preferably performed on the toner particles, which have been washed to remove any excess surfactant.

Functional groups can be introduced onto surfaces of toner particles by partially using, as the polymerizable monomers, acids (e.g., acrylic acid, methacrylic acid, α-cyano acrylic acid, α-cyano methacrylic acid, itaconic acid, crotonic acid, fumaric acid, maleic acid, and maleic anhydride), and acrylates or methacrylates including amino groups (e.g., acryl amide, methacryl amide, diacetone acryl amide, or methylol compounds of the above-listed acryl amides, vinyl pyridine, vinyl pyrrolidone, vinyl imidazole, ethylene imide, and dimethylaminoethyl methacrylate.

Moreover, a functional group can be introduced on a surface of particle by selecting a dispersing agent including an acid group or a basic group as a dispersing agent for use, and leaving the dispersing agent on the surface of the particle by adsorption.

<<Emulsion Polymerization Aggregation Method>>

A water-soluble polymerization initiator and a polymerizable monomer are emulsified in water using a surfactant, and a latex is synthesized according to a typical emulsion polymerization method. Separately, a dispersion, where a colorant, a release agent particle diameters of which are controlled, and a charge-controlling agent are dispersed in an aqueous medium, is prepared. After mixing the latex with the dispersion, the particles are aggregated to a toner size, and base particles are obtained by heat fusion. Thereafter, a wet treatment of inorganic particles may be performed. Functional groups can be introduced on surfaces of the toner particles by using, as a latex, the similar monomer to the monomer used for the suspension polymerization.

<<Polymer Suspension>>

An aqueous medium for use in the present disclosure may be water alone, or water in combination with a solvent miscible with water. Examples of the solvent miscible with water include alcohols (e.g., methanol, isopropanol, and ethylene glycol), dimethylformamide, tetrahydrofuran, cellosolves (e.g., methylcellosolve), and lower ketones (e.g., acetone, and methyl ethyl ketone). An oil phase of the toner composition is a volatile solvent, in which a binder resin, a prepolymer, a colorant, such as a pigment, a release agent a particle size of which is controlled, and a charge-controlling agent is dissolved or dispersed.

In an aqueous medium, the oil phase composed of the toner composition is dispersed in the presence of a surfactant or a solid dispersing agent to allow the prepolymer to react to thereby form particles. Thereafter, a wet treatment of inorganic particles can be performed.

<<Dry Pulverization>>

As one example of a pulverization-based method, used can be a production method of a toner including a step, in which raw materials including at least a binder resin, a colorant, a charge-controlling agent, and a release agent are mechanically dry-mixed, a step including melting and kneading, a step including pulverizing, and a step including classifying. In order to improve dispersibility of a colorant, the colorant is turned into a master batch, and then the master batch is mixed with other raw materials, followed by a following step.

A toner produced by pulverization is preferable because a peak ratio C/R can be controlled.

The mixing step where mechanical mixing is performed can be performed under typical conditions using a typical mixer with a rotatable blade, and is not particularly limited. After completing the above-described mixing step, a kneader is charged with the resultant mixture and melt-kneading is performed on the mixture. As the melt-kneading device, a single-screw or twin-screw continuous kneader, or a batch kneader with a roll mill can be used. As a specific device for kneading the toner, a batch-type twin rolls, a Banbury mixer, a continuous twin-screw extruder (e.g., KTK twin-screw extruder available from Kobe Steel, Ltd., TEM twin-screw kneader available from TOSHIBA MACHINE CO., LTD., a twin-screw extruder available from KCK, PCM twin-screw extruder available from IKEGAI, and KEX twin-screw extruder available from Kurimoto, Ltd.) or a continuous single-screw kneader (e.g., a co-kneader available from BUSS) can be suitably used. The melt-kneaded product obtained in the above-described manner is cooled, followed by pulverizing. For example, the pulverization is performed by roughly pulverizing a hummer mill or Rotoplex, followed by finely pulverizing using a fine pulverizer using a jet flow or a mechanical fine pulverizer. The pulverization is preferably performed in a manner that a number average particle diameter of the resultant particles is to be from 3 μm through 10 μm.

Moreover, a particle size of the pulverized product is adjusted to from 2.5 μm through 20 μm by means of a wind classifier.

In the course of the pulverization, a thickness of the kneaded product is preferably adjusted to 2.5 mm or greater, more preferably 2.5 mm or greater but 8 mm or less in the cooling step after melt-kneading the raw materials.

Subsequently, the external additives are externally added to base particles. Surfaces of the base particles are coated with the external additives, while the external additives are crushed, by mixing and stirring the base particles and the external additives by means of a mixer.

(Developer)

A developer of the present disclosure includes at least the toner, and may further include appropriately selected other ingredients, such as a carrier, according to the necessity.

Therefore, high quality images having excellent transfer properties and chargeability can be stably formed. Note that, the developer may be a one-component developer or two-component developer. In the case where the developer is used for a high-speed printer corresponding to recent information processing speed, the developer is preferably a two-component developer because a service life is improved.

<Carrier>

A carrier is not particularly limited and may be appropriately selected depending on the intended purpose. Examples of the carrier include a magnetic carrier and a resin carrier. As the magnetic carrier, magnetic carrier know in the art, such as an iron powder, a ferrite powder, a magnetite power, and a magnetic resin carrier all of which have particle diameters of from about 20 μm through 200 μm, can be used. As a ratio of the carrier to the toner in the developer, an amount of the toner is preferably 1 part by mass through 10 parts by mass relative to 100 parts by mass of the carrier.

The carrier is preferably a carrier including carrier particles, each of which includes a core and a resin layer covering the core.

(Toner Stored Unit)

A toner stored unit for use in the present disclosure includes a unit having a function of storing a toner, and the toner stored in the unit. Examples of an embodiment of the toner stored unit include a toner stored container, a developing device, and a process cartridge.

The toner stored container is a container, in which the toner is stored.

The developing device is a developing device, which stored the toner therein and has a unit configured to perform developing.

The process cartridge includes an integrated body of at least an electrostatic latent image bearer (also referred to as an image bearer) and a developing unit, stores the toner therein, and can be detachably mounted in an image forming apparatus. The process cartridge may further include at least one selected from the group consisting of a charging unit, an exposure unit, and a cleaning unit.

A high-quality and high-resolution image having a long-term image stability can be formed by mounting the toner stored unit of the present disclosure in an image forming apparatus and performing image formation, with utilizing the properties of the toner, which includes excellent low-temperature fixability, antiblocking of paper ejection, and release properties, and prevention of breakage even when stress is applied inside a developing device.

(Image Forming Apparatus and Image Forming Method)

An image forming apparatus of the present disclosure includes at least an electrostatic latent image bearer, an electrostatic latent image forming unit, and a developing unit, and may further include other units according to the necessity.

An image forming method of the present disclosure includes at least an electrostatic latent image forming step, and a developing step, and may further include other steps according to the necessity.

The image forming method is suitably performed by the image forming apparatus. The electrostatic latent image forming step is suitably performed by the electrostatic latent image forming unit. The developing step is suitably performed by the developing unit. The above-mentioned other steps can be suitably performed by the above-mentioned other units.

The image forming apparatus of the present disclosure more preferably includes an electrostatic latent image bearer, an electrostatic latent image forming unit configured to form an electrostatic latent image on the electrostatic latent image bearer, a developing unit, which stores the toner and is configured to develop using the toner the electrostatic latent image formed on the electrostatic latent image bearer to form a toner image, a transfer unit configured to transfer the toner image formed on the electrostatic latent image bearer on a surface of a recording medium, and a fixing unit configured to fix the toner image transferred on the surface of the recording medium.

Moreover, the image forming method of the present disclosure more preferably includes an electrostatic latent image forming step including forming an electrostatic latent image on an electrostatic latent image bearer, a developing step including developing the electrostatic latent image formed on the electrostatic latent image bearer using the toner to form a toner image, a transfer step including transferring the toner image formed on the electrostatic latent image bearer to a surface of a recording medium, and a fixing step including fixing the toner image transferred on the surface of the recording medium.

In the developing unit and the developing step, the toner is used. Preferably, the toner image is formed by using a developer including the toner and other ingredients, such as a carrier, according to the necessity.

<Electrostatic Latent Image Bearer>

A material, structure, and size of the electrostatic latent image bearer are not particularly limited, and may be appropriately selected from materials, structures, and sizes of electrostatic latent image bearers known in the art. Examples of the material of the electrostatic latent image bearer include: inorganic photoconductors, such as amorphous silicon and selenium; and organic photoconductors, such as polysilane, and phthalopolymethine.

<Electrostatic Latent Image Forming Unit>

The electrostatic latent image forming unit is not particularly limited as long as the electrostatic latent image forming unit is a unit configured to form an electrostatic latent image on the electrostatic latent image bearer, and may be appropriately selected depending on the intended purpose. Examples of the electrostatic latent image forming unit include a unit including at least a charging member configured to charge a surface of the electrostatic latent image bearer, and an exposing member configured to expose the surface of the electrostatic latent image bearer to light image wise.

<Developing Unit>

The developing unit is not particularly limited, and may be appropriately selected depending on the intended purpose, as long as the developing unit is a developing unit, which is configured to develop the electrostatic latent image formed on the electrostatic latent image bearing member to form a visible image, and contains a toner.

<Other Units>

Examples of the above-mentioned other units include a transferring unit, a fixing unit, a cleaning unit, a charge-eliminating unit, a recycling unit, and a controlling unit.

Next, one embodiment for performing a method for forming an image by the image forming apparatus of the present disclosure is described with reference to FIG. 5.

Figure 5:
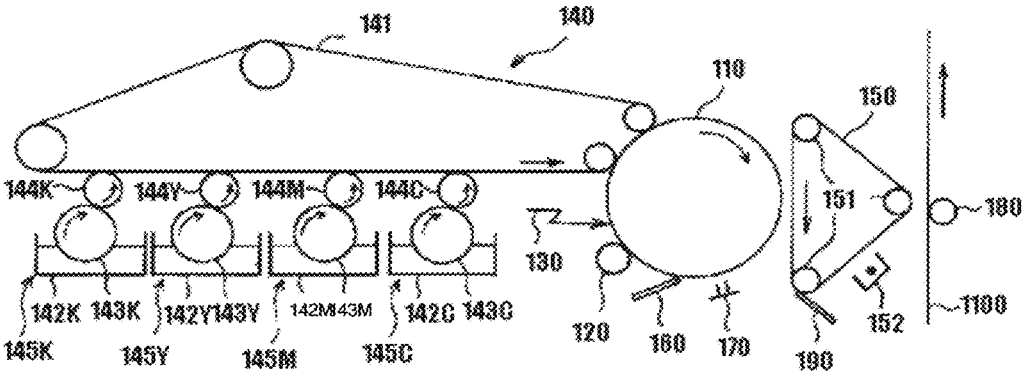
FIG. 5 is a schematic structural view illustrating one example of the image forming apparatus of the present disclosure.

FIG. 5 is a schematic structural view illustrating one example of the image forming apparatus. At the periphery of the photoconductor drum (referred to as a photoconductor hereinafter) 110 serving as an image bearer, a charging roller 120 serving as a charging device, an exposing device 130, a cleaning device 160 including a cleaning blade, a discharge lamp 170 serving as a charge-eliminating device, a developing device 140, and an intermediate transfer member 150 serving as an intermediate transfer member are disposed. The intermediate transfer member 150 is supported by a plurality of suspension rollers 151, and is arranged in a manner that the intermediate transfer member 150 is traveled endlessly along the direction indicated with an arrow by a driving unit, such as a motor, which is not illustrated. Part of the suspension rollers 151 also functions as a transfer bias roller configured to supply transfer bias to the intermediate transfer member, and predetermined transfer bias voltage is applied from a power source, which is not illustrated. Moreover, disposed is a cleaning device 190 having a cleaning blade for the intermediate transfer member 150. Moreover, a transfer roller 180 is disposed as a transfer member to face the intermediate transfer member 150, and the transfer member is configured to transfer a developed image to a transfer sheet 1100 serving as a final transfer material. Transfer bias is supplied to the transfer roller 180 from a power source that is not illustrated. Then, a corona charger 152 serving as a charge-applying unit is disposed at the periphery of the intermediate transfer member 150.

The developing device 140 is composed of a developing belt 141 serving as a developer bearer, a black (referred to as Bk hereinafter) developing unit 145K, a yellow (referred to as Y hereinafter) developing unit 145Y, a magenta (referred to as magenta hereinafter) developing unit 145M, and a cyan (referred to as C hereinafter) developing unit 145C, all of which are disposed parallel at a periphery of the developing belt 141. Moreover, the developing belt 141 is supported by a plurality of belt rollers, and is arranged in a manner that the developing belt 141 travels endlessly along the direction indicated with the arrow by a driving unit, such as a motor, which is not illustrated. The developing belt 141 travels substantially at the same speed as the speed of the photoconductor 110 at the contact area with the photoconductor 110.

Since structures of the developing units are identical, only the Bk developing unit 145K is described below. Descriptions of other developing units 145Y, 145M, and 145C are omitted, and the areas or units corresponding to the Bk developing unit 145K in FIG. 5 are indicated with Y, M, or C after the numbers. The Bk developing unit 145K includes a developing tank 142K storing a high-viscous and high-concentration liquid developer including toner particles and a carrier liquid component, a drawing-up roller 143K disposed in a manner that the bottom part of the roller is immersed in a liquid developer in the developing tank 142K, and a coating roller 144K configured to make the developer drawn by the drawing-up roller 143K into a thin layer to apply onto a developing belt 141. The coating roller 144K has conductivity and predetermined bias is applied to the coating roller 144K from a power source that is not illustrated.

Figure 6:
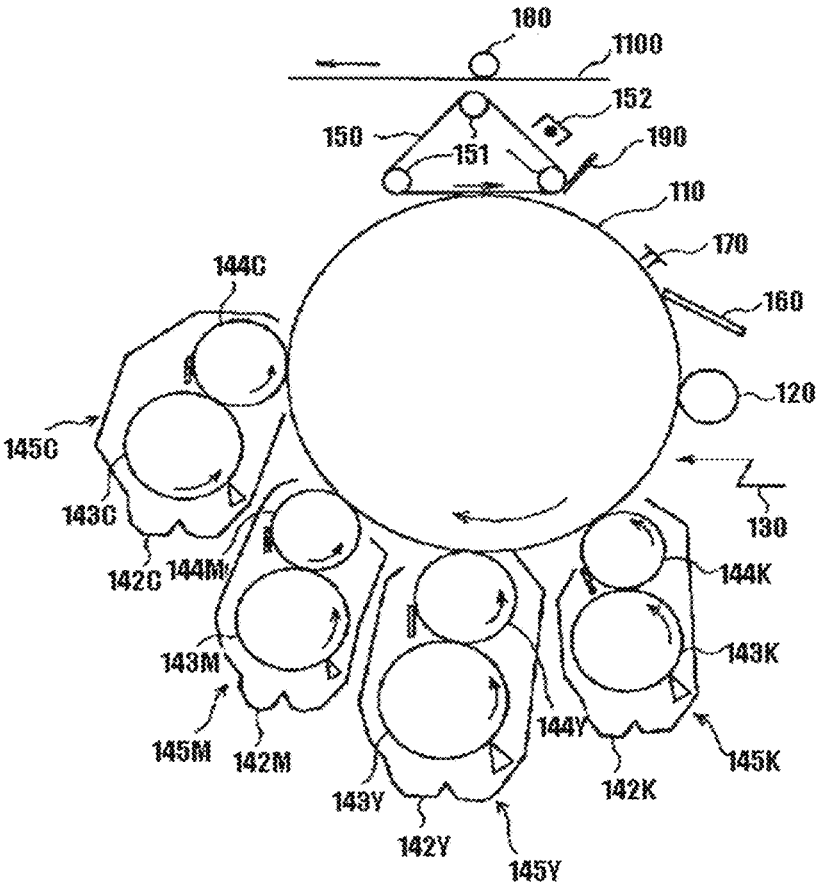
FIG. 6 is a schematic structural view illustrating one example of the image forming apparatus of the present disclosure.

Note that, a structure of the device of the photocopier according to the present embodiment may be a device structure where all colors of developing units 145 are disposed around a photoconductor 110 as illustrated in FIG. 6, other than the device structure illustrated in FIG. 5.

Subsequently, operations of an image forming apparatus according to the present embodiment are explained. In FIG. 5, after uniformly charging a photoconductor 110 with a charging roller 120 with rotationally driving the photoconductor 110 in a direction indicated with an arrow, reflection light from a document is projected to form an image with an optical system, which is not illustrated, to thereby form an electrostatic latent image on the photoconductor 110 by an exposing device 130. The electrostatic latent image is developed by a developing device 140 to form a toner image as a visible image. A developer layer on a developing belt 141 is released from the developing belt 141 in a state of a thin layer by contact with the photoconductor in the developing region, and is transferred onto an area of the photoconductor 110 where the latent image is formed. The toner image developed by the developing device 140 is transferred (primary transfer) onto a surface of an intermediate transfer member 150 at a contact part (primary transfer region) with the intermediate transfer member 150 traveling at the same speed as the photoconductor 110. In the case where transfer to overlap three or four colors is performed, the above-described step is repeated for each color, to form a color image on the intermediate transfer member 150.

A corona charger 152 configured to apply charge to overlapped toner images on intermediate transfer member is disposed at a position that is downstream of the contact facing part between the photoconductor 110 and the intermediate transfer member 150 in the rotational direction of the intermediate transfer member 150, and upstream of a contact facing part between the intermediate transfer member 150 and a transfer sheet 1100. The corona charger 152 applies true electric charge to the toner images, where the true electric charge has the same polarity to the polarity of the charge of the toner particles forming the toner images, and applies sufficient electric charge to perform excellent transfer to the transfer sheet 1100. After charging the toner images with the corona charger 152, the toner images are transferred (secondary transfer) all at once onto the transfer sheet 1100 transported from a paper feeding part, which is not illustrated, by transfer bias applied from the toner image transfer roller 180. Thereafter, the transfer sheet 1100, to which the toner images have been transferred, is separated from the photoconductor 110 by a separator, which is not illustrated, and subjected to a fixing treatment by a fixing device, which is not illustrated, followed by ejecting the sheet from the device. Meanwhile, the photoconductor 110 after the transfer is cleaned by a cleaning device 160 to remove and collect untransferred toner particles, and the residual charge of the photoconductor 110 is eliminated by a discharging lamp 170 to be ready for next charging. A color image is typically formed with four color toners. In one color image, from one layer through four layers of toner layers are formed. The toner layers are passed through the primary transfer (transfer from the photoconductor to the intermediate transfer belt), and the secondary transfer (transfer from the intermediate transfer belt to the sheet).

—Tandem Color Image Forming Apparatus—

Figure 7:
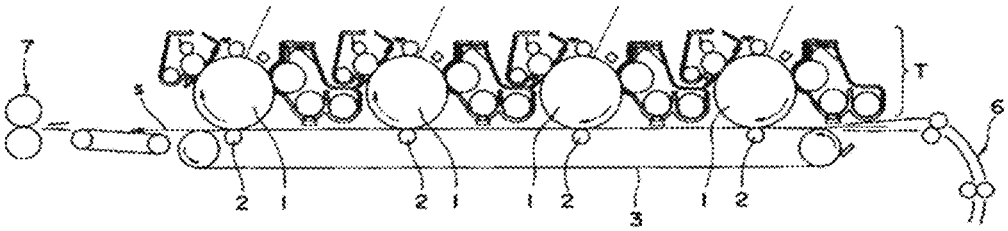
FIG. 7 is a schematic structural view illustrating one example of a tandem color image forming apparatus, which is another image forming apparatus of the present disclosure.
Figure 8:
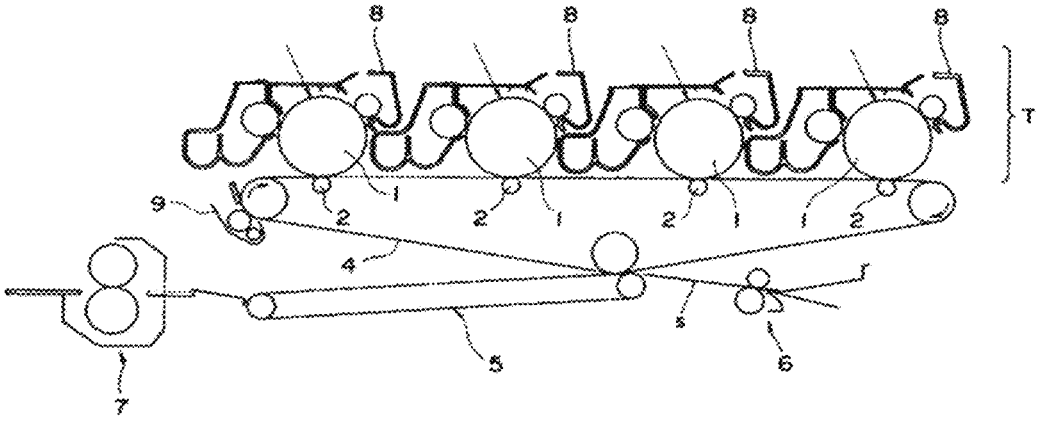
FIG. 8 is a schematic structural view illustrating one example of a tandem color image forming apparatus, which is another image forming apparatus of the present disclosure.

The image forming apparatus of the present disclosure can be also used as a tandem color image forming apparatus. One example of an embodiment of the tandem color image forming apparatus is described. The tandem electrophotographic device includes a tandem electrophotographic device of a direct transfer system, where images on photoconductors 1 are sequentially transferred onto a sheet, which is conveyed by a sheet conveyance belt 3, by a transfer device 2, as illustrated in FIG. 7, and a tandem electrophotographic device of an indirect system, where images on photoconductors 1 are sequentially temporarily transferred onto an intermediate transfer member 4 by a primary transfer device 2, followed by the images on the intermediate transfer member 4 are transferred at once on a sheet s by a secondary transfer device 5, as illustrated in FIG. 8. The secondary transfer device 5 is a transfer conveyance belt, but may be of a roller system.

Comparing the direct transfer system with the indirect transfer system, the direct transfer system has a disadvantage that a paper feeding device 6 is disposed at the upstream side of the tandem image forming apparatus T, in which the photoconductors 1 are aligned, and a fixing device 7 is disposed at the downstream side of the tandem image forming apparatus T, and therefore a size of the system is large along a sheet-conveying direction. On the other hand, a secondary transfer position can be relatively freely set in the indirect transfer system. Therefore, the paper feeding device 6 and the fixing device 7 can be disposed to overlap with the tandem image forming apparatus T, hence the indirect transfer system has an advantage that the system can be made small.

In order to prevent the direct transfer system from increasing the size of the system along the sheet-conveying direction, the fixing device 7 is disposed close to the tandem image forming apparatus T. Therefore, the fixing device 7 cannot be disposed to give a sufficient space to allow the sheet s to bend, which leads to a disadvantage that image formation at the upstream side of the fixing device 7 may be adversely affected by an impact when the edge of the sheet s enters the fixing device 7 (which is significant particularly with a thick sheet), or a speed difference between the sheet-conveying speed when the sheet s passes through the fixing device 7 and the sheet-conveying speed by the transfer convey belt.

On the other hand, the fixing device 7 can be disposed in the indirect transfer system to give a sufficient space to allow the sheet s to bend. Therefore, the fixing device 7 hardly affects image formation.

From the reasons as described above, particularly an indirect system tandem electrophotographic device has been attracted attentions among all types of tandem electrophotographic devices.

As illustrated in FIG. 8, the residual toner on the photoconductor 1 after the primary transfer is removed by the photoconductor cleaning device 8 to clean a surface of the photoconductor 1 to be ready for the next image formation process in the indirect transfer system color electrophotographic device. Moreover, the residual toner on the intermediate transfer member 4 after the secondary transfer is removed by the intermediate transfer member cleaning device 9 to clean a surface of the intermediate transfer member 4 to be ready for the next image formation process.

Figure 9:
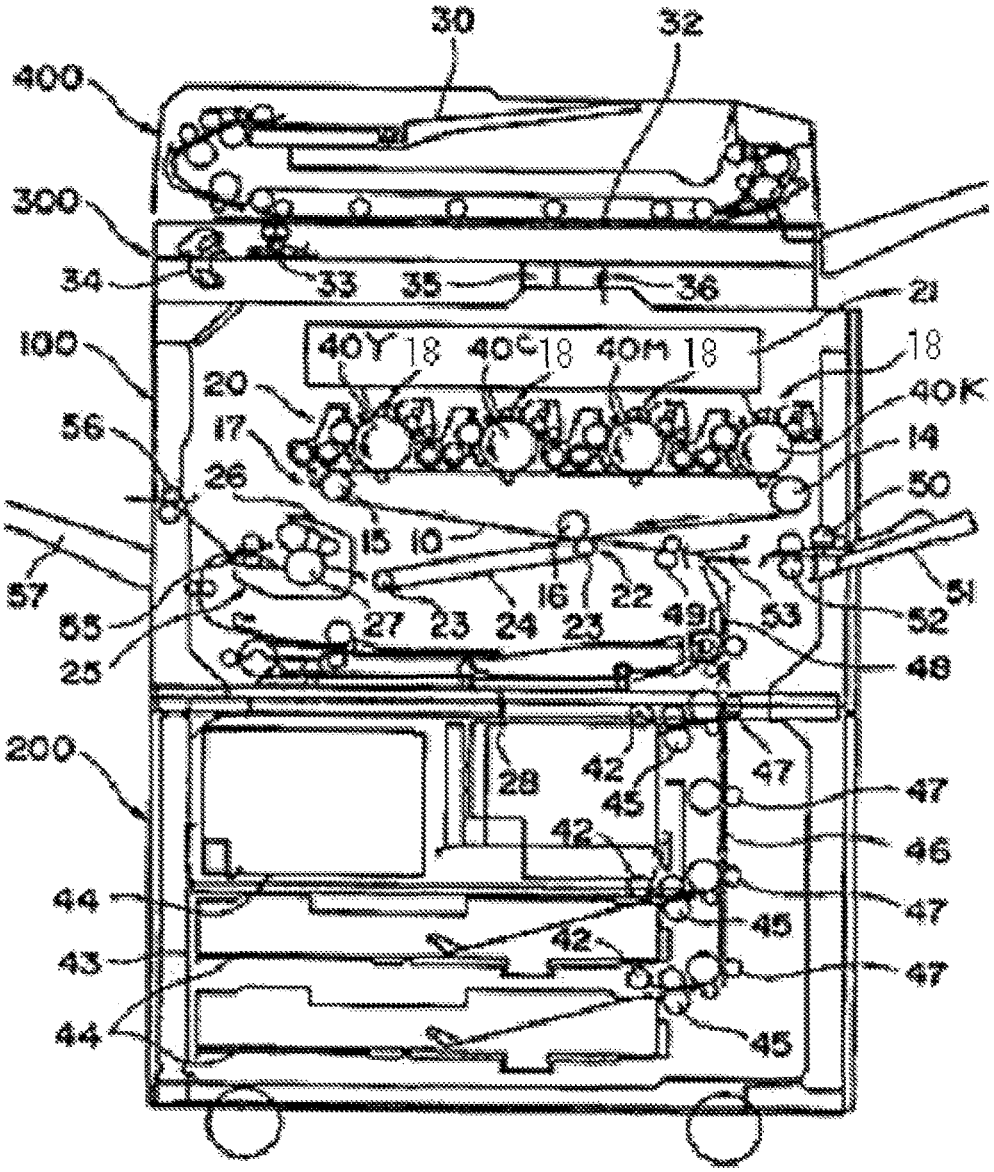
FIG. 9 is a schematic structural view illustrating one example of a tandem color image forming apparatus, which is another image forming apparatus of the present disclosure.

FIG. 9 illustrates one embodiment of the present disclosure, and illustrates a tandem indirect-transfer electrophotographic device. In FIG. 9, the reference numeral 100 represents a photocopier main body, the reference numeral 200 represents a paper feeding table for placing the photocopier main body thereon, the reference numeral 300 represents a scanner installed on the photocopier main body 100, and the reference numeral 400 represents an automatic document feeder (ADF) installed thereon. An intermediate transfer member 10 of an endless belt type is disposed at a center of the photocopier main body 100.

As illustrated in FIG. 9, the intermediate transfer member 10 is passed around three supporting rollers 14, 15 and 16 in the illustrated example, and arranged to be rotatable in a clockwise direction in FIG. 9.

In the illustrated example, an intermediate transfer member cleaning device 17, which is configured to remove residual toners on the intermediate transfer member 10 after the image transfer, is disposed at the left side of the second supporting roller 15 among the three rollers.

Moreover, four image forming units 18 of yellow, cyan, magenta, and black are disposed parallel along the conveying direction of the intermediate transfer member 10, above the intermediate transfer member 10 stretched between the first supporting roller 14 and the second supporting roller 15 between the three rollers, to thereby compose the tandem image forming apparatus 20.

As illustrated in FIG. 9, an exposing device 21 is further disposed above the tandem image forming apparatus 20. Meanwhile, a secondary transfer device 22 is disposed at an opposite side of the tandem image forming apparatus 20 via the intermediate transfer member 10. In the illustrated example, the secondary transfer device 22 is composed by stretching a secondary transfer belt 24, which is an endless belt, between two rollers 23, is disposed to press against the third supporting roller 16 via the intermediate transfer member 10, and is configured to transfer an image onto the intermediate transfer member 10.

A fixing device 25 configured to fix the transferred image into a sheet is disposed next to the secondary transfer device 22. The fixing device 25 is composed by pressing a press roller 27 against a fixing belt 26, which is an endless belt.

The above-described secondary transfer device 22 also has a sheet transferring function for transferring the sheet after the image transfer to the fixing device 25. Needless to say, a transfer roller or a non-contact charger may be disposed as the second transfer device 22. In such a case, it is difficult to impart the sheet transferring function to the second transfer device.

In the illustrated example, a sheet reverser 28 configured to reverse the sheet to record images on both sides of the sheet is disposed parallel to the above-described tandem image forming apparatus 20 below the second transfer device 22 and the fixing device 25.

When a photocopy is taken by the above-described color electrophotographic device, a document is set on a document table 30 of the automatic document feeder 400. Alternatively, the automatic document feeder 400 is opened, a document is set on contact glass 32 of the scanner 300, and then the automatic document feeder 400 is closed to press the document down.

In the case where the document is set on the automatic document feeder 400, once a start switch, which is not illustrated, is pressed, the document is transported onto the contact glass 32, and then the scanner 300 is driven to scan the document with a first carriage 33 and a second carriage 34. In the case where the document is set on the contact glass 32, the scanner 300 is immediately driven in the same manner as mentioned. Light is emitted from a light source towards a surface of the document by the first carriage 33 and reflected the reflection light from the surface of the document towards the second carriage 34. The reflection light is then reflected by a mirror of the second carriage 34 to pass through an image forming lens 35 to lead to a read sensor 36. In this manner, the contents of the document are read.

Once the start switch, which is not illustrated, is pressed, moreover, one of the supporting rollers 14, 15, and 16 is driven to rotate by a driving motor, which is not illustrate, to rotate other two rollers, to rotate and convey the intermediate transfer member 10. At the same time, the photoconductor 40 of each of the image forming units 18 is rotated to form a single color image of black, yellow, magenta, or cyan on each photoconductor 40. Then, the single images are sequentially transferred on the intermediate transfer member 10 to form a composite color image, as the intermediate transfer member 10 is conveyed.

Once a start switch, which is not illustrated, is pressed, meanwhile, one of paper feeding rollers 42 of the paper feeding table 200 is selectively rotated to feed sheets from one of vertically stacked paper feeding cassette 44 housed in a paper bank 43. The sheets are separated one another by a separation roller 45. The separated sheet is fed through a paper feeding path 46, then fed through a paper feeding path 48 in the copying device main body 100 by conveying with a conveyance roller 47, and is stopped at a registration roller 49.

Alternatively, paper feeding rollers 50 are rotated to feed sheets on a bypass feeder 51. The sheets are separated one another by a separation roller 52. The separated sheet is fed through a manual paper feeding path 53, and is stopped at the registration roller 49 in the similar manner.

The registration roller 49 is rotated to synchronously with the movement of the composite color image on the intermediate transfer member 10, to thereby send the sheet between the intermediate transfer member 10 and the secondary transfer device 22. The composite color image is transferred on the sheet by the secondary transfer device 22 to thereby record the color image on the sheet.

The sheet after the image transfer is sent to the fixing device 25 by conveying the sheet with the secondary transfer device 22. After fixing the transferred image by applying heat and pressure by the fixing device 25, the traveling direction of the sheet is changed by the switch craw 55 to eject the sheet by the ejecting roller 56 to stack on the paper ejection tray 57. Alternatively, the sheet is sent to the sheet reverser 28 by changing the traveling direction of the sheet with the switch craw 55. The sheet is reversed by the sheet reverser 28 to again guide to a transfer position. After recording an image also on a back side of the sheet, the sheet is ejected into the paper ejection tray 57 by the ejection roller 56.

Meanwhile, the intermediate transfer member 10 after the image transfer is prepared for another image formation by the tandem image forming apparatus 20 by removing the residual toner on the intermediate transfer member 10 after the image transfer by the intermediate transfer member cleaning device 17.

Typically, the registration roller 49 is often earthed for use, but bias may be applied to the registration roller 49 in order to remove a paper powder from the sheet.

EXAMPLES

The present disclosure will be described in more detail by way of the following Examples. However, the present disclosure should not be construed as being limited to these Examples. The unit "part(s)" represent "part(s) by mass" unless otherwise stated. Symbols "%" represent "% by mass" unless otherwise stated.

Production Example 1

<Production of Toner Base Particles 1>

<<Production of First Amorphous Resin (Resin H1)>>

Into a dropping funnel, 580 g of styrene, 115 g of butyl acrylate, and 33 g of acrylic acid were added as vinyl-based monomers, and 30 g of dicumyl peroxide was added as a polymerization initiator. A 5 L four-necked flask equipped with a thermometer, a stainless steel stirrer, a downflow condenser, and a nitrogen inlet tube was charged with 1,090 g of polyoxypropylene(2.2)-2,2-bis(4-hydroxyphenyl)propane and 400 g of polyoxyethylene(2.2)-2,2-bis(4-hydroxyphenyl)propane as polyols among polyester monomers, 230 g of isododecenyl succinic anhydride, 330 g of terephthalic acid, 180 g of 1,2,4-benzenetricarboxylic anhydride, and 7 g of dibutyl tin oxide serving as an esterification catalyst. To the resultant mixture, the mixed solution of the vinyl-based monomer resins and the polymerization initiator was dripped by the dropping funnel over 1 hour, with stirring at a temperature of 175° C. in a nitrogen atmosphere in a mantle heater. With maintaining the temperature at 175° C., the mixture was matured by performing an addition polymerization reaction for 2 hours, followed by heating to 230° C. to perform a condensation polymerization reaction. A degree of polymerization was tracked with a softening point measured by a constant-load-extrusion capillary rheometer.

When the softening point reached a desired softening point, the reaction was terminated to thereby obtain Resin H1. The softening point of the resin was 128° C.

<<Production of Second Amorphous Resin (Resin L1)>>

A 5 L four-necked flask equipped with a thermometer, a stainless steel stirrer, a downflow condenser, and a nitrogen inlet tube was charged with 2,260 g of polyoxypropylene (2.2)-2,2-bis(4-hydroxyphenyl)propane as polyol, 820 g of terephthalic acid, 180 g of 1,2,4-benzenetricarboxylic anhydride, and 0.6 g of dibutyl tin oxide as an esterification catalyst. The resultant mixture was heated to 230° C. in a nitrogen atmosphere in a mantle heater to allow the mixture to perform a condensation polymerization reaction. A degree of polymerization was tracked with a softening point measured by a constant-load-extrusion capillary rheometer. When the softening point reached a desired softening point, the reaction was terminated to thereby obtain Resin L1. The softening point of the resin was 110° C.

<Pulverized Toner Production Example 1>

By means of HENSCHEL MIXER 20B (NIPPON COKE & ENGINEERING CO., LTD.), 30 parts of Resin H1, 70 parts of Resin H2, 6.8 parts of carbon black (REGAL 400R, available from Cabot Corporation) as a colorant, 4.0 parts of carnauba wax (melting point: 81° C.) as a release agent, and 1.2 parts of a charge-controlling agent "BONTRON E-84" (available from ORIENT CHEMICAL INDUSTRIES CO., LTD.) were mixed at 1,200 rpm. The obtained mixture was kneaded by means of a BUSS co-kneader MDK45 (available from BUSS Company) [feeding amount: 10 kg/hr, screw revolution speed: 80 rpm, screw temperature: 40° C., set temperatures (Z1 temperature: 100° C., Z2 and Z3 temperatures: 80° C.), which was a continuous kneader, to thereby obtain a kneaded product.

Subsequently, the obtained kneaded product was cooled in the air, followed by roughly pulverizing the kneaded product using Rotoplex (available from HOSOKAWA ALPINE Aktiengesellschaft), to obtain a coarse pulverized product having a volume median diameter (D50v) of 800 μm.

Furthermore, the obtained pulverized product was treated by means of IDS-2 pulverizer (available from NIPPON PNEUMATIC MFG. CO., LTD.) and Elbow-Jet Air Classifier, to thereby obtain Toner Base Particles 1 having a volume average diameter of 7.5 μm, and an average circularity of 0.926.

Tg of Toner Base Particles 1 was measured, and the result was 61.5° C.

Production Example 2

<Production of Toner Base Particles 2>

<<Preparation of Polyester Resin Dispersion Liquid 1>>

| | |
|---|---|
| Terephthalic acid | 57 parts |
| Fumaric acid | 134 parts |
| Bisphenol A ethylene oxide adduct | 38 parts |
| Bisphenol A propylene oxide adduct | 339 parts |

A flask having an inner volume of 5 L and equipped with a stirrer, a nitrogen inlet tube, a temperature sensor, and a rectifying column was charged with the above-listed monomers, a temperature of the reaction system was elevated to 210° C. over 1 hour. After confirming that the reaction system was stirred, 1 part of titanium tetraethoxide was added.

The temperature was increased from the above-mentioned temperature to 230° C. over 1 hour while removing water generated, and the dehydration condensation reaction was continued further for 1 hour at 230° C., to thereby obtain Amorphous Polyester Resin 1 having an acid value of 14.0 mg/KOH and a weight average molecular weight of 16,000.

Subsequently, Amorphous Polyester Resin 1 in the melted state was sent to CAVITRON CD1010 (available from Euro Tec) at the rate of 120 g/min. A separately-prepared aqueous medium tank was charged with diluted ammonia water having a concentration of 0.4%, where reagent ammonia water had been diluted with ion-exchanged water, and the diluted ammonia water was sent to CAVITRON CD1010 at the same time as the above-mentioned amorphous polyester resin melt, at the rate of 0.1 L/min, while heating the diluted ammonia water to 105° C. by a heat exchanger. Thereafter, the pH of the system was adjusted to 8.0 with 0.5 mol/L of a sodium hydroxide aqueous solution, and the mixture was treated at 45° C. for 3 hours. Thereafter, the pH was adjusted to 7.0 with a nitric acid solution, and a solid content was adjusted, to thereby obtain Polyester Resin Dispersion Liquid 1 including polyester resin particles having an average particle diameter of 180 nm and in an amount of 30% by mass based on a solid content.

<<Preparation of Colorant Particle Dispersion Liquid>>

Carbon black (REGAL 330, available from Cabot Corporation) in an amount of 45 parts, 5 parts of an ionic surfactant NEOGEN R (available from DKS Co., Ltd.), and 200 parts of ion-exchanged water were mixed and dissolved, and the resultant mixture was dispersed for 10 minutes by means of a homogenizer (IKA ULTRA-TURRAX), followed by performing a dispersion treatment using Ultimizer, to thereby obtain a colorant particle dispersion liquid having a center particle diameter of 240 nm and a solid content of 21%.

<<Preparation of Release Agent Dispersion Liquid>>

| | |
|---|---|
| Paraffin wax HNP9 (melting point: 75° C., available from NIPPON SEIRO CO., LTD.) | 45 parts |
| Cationic surfactant NEOGEN RK (available from DKS Co., Ltd.) | 5 parts |
| Ion-exchanged water | 200 parts |

The above-listed ingredients were heated to 85° C., and were dispersed by means of ULTRA-TURRAX T50 available from IKA.

Thereafter, the resultant was subjected to a dispersion treatment performed by pressure-discharge Gaulin Homogenizer to thereby obtain a release agent dispersion liquid having a center diameter of 190 nm and a solid content of 20.0% by mass.

<<Production of Toner Particles>>

Polyester resin dispersion liquid 1: 280 parts

Colorant particle dispersion liquid: 27 parts

Release agent dispersion liquid: 30 parts

The above-listed ingredients in a stainless-steel round flask were mixed and dispersed by ULTRA-TURRAXT50. Subsequently, 5 parts of aluminium polyhydrooxide (Paho2S available from ASADA CHEMICAL INDUSTRY CO., LTD.) was added to the resultant, and the dispersion operation by ULTRA-TURRAX was continued on the resultant mixture. The flask was heated to 50° C. in an oil bath for heating with stirring. After maintaining the temperature to 50° C. for 90 minutes, 65.0 parts of the resin dispersion liquid 1 was added.

Thereafter, the pH of the system was adjusted to 8.6 with a 0.5 mol/L sodium hydroxide aqueous solution, followed by sealing the stainless steel flask. The mixture was heated up to 80° C. with stirring using a magnetic seal, and the temperature was maintained for 5 hours.

After the termination of the reaction, the reaction product was cooled, filtered, washed with ion-exchanged water, and subjected to solid-liquid separation through Nutsche suction filtration. The resultant was again dispersed in 1 L of ion-exchanged water at 35° C., stirred at 250 rpm for 10 minutes, and then washed. This series of processes was repeated 5 times. The filtrate obtained had electric conductivity of 4.5 μS/cmt. Thereafter, solid-liquid separation was performed by Nutsche suction filtration, followed by performing vacuum drying for 12 hours, to thereby obtain Toner Base Particles 2 having a volume average particle diameter of 6.0 μm and an average circularity of 0.960.

Tg of Toner Base Particles 2 was measured, and the result was 59.3° C.

Moreover, it was found from the measurement result of SEM of the cross-section of the toner that the average thickness of the shell layer was about 230 nm.

Preparation Example 1

<Preparation of Silica 1>

An autoclave equipped with a stirrer was charged with silica particle base (A1; AEROSIL 300, available from NIPPON AEROSIL CO., LTD., hydrophilicity-untreated product), a number average particle diameter (D1) of primary particles of which was 7 nm. Thereafter, the silica particle base was heated to a temperature of 200° C. in a fluidized state created by stirring, to thereby obtain Base Product 1.

While stirring inside a reaction tank, 10 parts by mass of dimethyl silicone oil (viscosity: 50 cs) was sprayed to 100 parts by mass of Base Product 1. After continuously stirring for 30 minutes, the temperature was elevated to 300° C. with stirring, and then stirring was continued for another 2 hours. Thereafter, the resultant was taken out from the reaction tank, and a grinding treatment was performed on the resultant by means of a pin crusher.

Next, a reaction vessel was purged with nitrogen gas, followed by sealing the reaction vessel. Inside the reaction vessel, 10 parts by mass of hexamethyl disilazane was sprayed inside relative to 100 parts by mass of Base Product 1, to thereby perform a silane compound treatment.

After continuing the above-mentioned reaction for 60 minutes, the reaction was terminated.

After terminating the reaction, the autoclave was depressurized, and the resultant product was washed with a nitrogen gas flow to remove excessive hexamethyl disilazane and side products. Thereafter, the resultant product was subjected to one-pass of a grinding treatment by a pulverizer (available from HOSOKAWA MICRON CORPORATION) to obtain Silica Particles 1.

Preparation Example 2

<Preparation of Silica 2>

Silica Particles 2 were obtained in the same manner as in Preparation Example 1, except that the silica particle base was replaced with silica particle base (A2; AEROSIL 200, available from NIPPON AEROSIL CO., LTD.) a number average particle diameter (D1) of primary particles of which was 12 nm.

Preparation Example 3

<Preparation of Silica 3>

Silica Particles 3 were obtained in the same manner as in Preparation Example 1, except that the silica particle base was replaced with silica particle base (A3; AEROSIL 90, available from NIPPON AEROSIL CO., LTD.) a number average particle diameter (D1) of primary particles of which was 23 nm.

Preparation Example 4

<Preparation of Silica 5>

Silica Particles 5 were obtained in the same manner as in Preparation Example 1, except that the silica particle base was replaced with a silica particle base (A5; UFP-30 untreated product, available from Denka Company Limited), which was spherical silica having primary particles having a number average particle diameter (D1) of 98 nm, and having a sharp particle size distribution.

Preparation Example 5

<Preparation of Titania 1>

As a first treatment step, 10 parts of isobutyl trimethoxysilane was sprayed onto 100 parts of needle-shaped rutile-type titanium oxide particles (MT-150 untreated product, available from TAYCA CORPORATION) including primary particles having a number average particle diameter of 15.0 nm, to perform a treatment with the silane compound onto the titanium oxide particles in the fluidized state. After continuing the above-described reaction for 60 minutes, the reaction was terminated.

As a second treatment step, 10 parts of dimethyl silicone oil was sprayed on the titanium oxide particles generated by the first treatment step, and the resultant particles were continuously stirred for 30 minutes. Thereafter, the temperature was elevated to 190° C. with stirring, and the particles were further stirred for 3 hours to fake the dimethyl silicone oil onto surface of the titanium oxide particles to thereby terminate the reaction. Thereafter, a grinding treatment was repeated by means of a pulverizer (available from HOSOKAWA MICRON CORPORATION) until aggregates of the titanium oxide particles disappeared, to thereby obtain Titanium Oxide Particles 1 (Titania 1) including primary particles having a number average particle diameter of 15 nm.

Examples 1 to 12 and 14 to 17, and Comparative Examples 1 to 12

The external additives were fixed onto the toner base particles under the following preliminary grinding conditions and fixation conditions as presented in Table 1-1 and Table 1-2. Subsequently, the external additives were added as presented in Table 2-1 and Table 2-2 to perform an external additive treatment, to thereby obtain Toners 1 to 12 and 14 to 29.

The particle diameters and circularity of Toner 1 were measured, and there was not particularly any change from the particle diameter of 7.5 μm and circularity of 0.925.

[Preliminary Grinding Conditions]

The preliminary grinding conditions when the preliminary grinding was performed before mixing each silica with the toner base particles were as follows.

A 20 L Q mixer was charged with 100 g through 300 g of raw material silica, and the silica was ground for 1 minute at a rim speed of 50 m/s.

The preliminary grinding is a pretreatment for resetting a history due to a difference in the storage conditions, and eliminating a difference in degrees of aggregation to secure uniformity.

As the grinding, an impact energy is preferably high to a certain degree. The rim speed is preferably 40 m/s or greater, practically, preferably from 40 m/s through 60 m/s. Moreover, the mixer for use is not limited to the Q mixer, and the same setting can be set with typical HENSCHEL MIXER.

[Fixation Conditions]

Fixation of external additives to toner base particles performed after mixing the toner base particles and the external additives was performed under the following conditions.

<Fixation Conditions No. 1 (Typical Setting)>

HENSCHEL MIXER having a volume of 20 L was charged with 2 kg of the toner base particles and amounts of external additives presented in Table 1-1, and the toner base particles and the external additives were mixed using water of 15° C. as jacket cooling water at the rim speed and for a duration presented in Table 1-2 to thereby perform fixation.

<Fixation Conditions No. 2>

Fixation was performed under the same conditions as Fixation conditions No. 1, except that the jacket cooling water was connected to a temperature controlled and was controlled to 30° C.

Note that the fixation conditions No. 2 were set with an intention of accelerating fixation with a support of temperature load caused by heating. When the temperature is too high during fixation, toner particles are aggregated due to Tg of the toner and influence of heat generated by the stirring. The temperature is preferably 40° C. or lower, and more preferably 30° C.±5° C.

<Fixation Conditions No. 3>

20 L HENSCHEL MIXER was charged with 2 kg of the toner base particles, and the external additives in the amounts presented in Table 1-1. The toner base particles of the external additives were mixed for 1 minutes at a rim speed of 30 m/s using water of 15° C. as jacket cooling water.

Subsequently, surface modification with heat was performed by means of a surface modifying device, Surfusing System (available from NIPPON PNEUMATIC MFG. CO., LTD.), under the following conditions.

Dispersion nozzles: 4 nozzles (symmetrically arranged with 90 degrees to each other)
Ejection angle: 30 degrees
How blast flow rate: 4 $m^3$/min
Injection air flow rate: 0.7 $m^3$/min
Blower wind amount: 10 $m^3$/min
How blast temperature: 135° C.
Feeding rate (sample supply rate): 2 kg/h
Cold blast temperature: 15° C.
Cooling water temperature: 5° C.

The external additives and the toner base particles treated under the conditions listed above to perform fixation.

<Fixation Conditions No. 4 (Wet Treatment 2 of Pulverized Toner)>

HENSCHEL MIXER (20 L) was charged with 2 kg of the toner base particles, and the external additives in the amounts presented in Table 1-1. The toner base particles of the external additives were preliminary mixed for 1 minute at a rim speed of 40 m/s using water of 15° C. as jacket cooling water, to thereby obtain a preliminary mixed toner.

Subsequently, a container equipped with a stirrer and an ultrasonic wave homogenizer (US-150T) was charged with 900 parts of ion-exchanged water and 8 parts of cationic surfactant NEOGEN RK (available from DKS Co., Ltd.). To the container, 300 parts of the preliminary mixed toner was gradually added with stirring, and the resultant was subjected ultrasonic dispersion by means of the ultrasonic wave homogenizer for 5 minutes at 200 μA. Thereafter, the resultant was transferred into a container equipped with a stirrer, a temperature sensor, and a temperature control unit for water temperature, and was gradually heated with stirring. After confirming the temperature reached 45° C., the pH was adjusted to 8.5, and the resultant was stirred for 4 hours with maintaining the temperature at 45° C., followed by cooling to 25° C. through 30° C. and subjected to filtration. The resultant was sufficiently washed with ion-exchanged water.

<Fixation Conditions No. 5 (Wet Treatment 2 of Pulverized Toner)>

Fixation was performed under the same conditions as Fixation conditions No. 4, except that the contained equipped with the stirrer and the ultrasonic wave homogenizer (US-150T) was replaced with TK Homomixer, and the treatment was performed for 10 minutes at the revolution speed of 3,500 rpm, and the temperature of 40° C.

TABLE 1-1

| | | Small-size silica | | | Mid-size silica | | | Small-size titanium | | Large-size silica | | |
|---|---|---|---|---|---|---|---|---|---|---|---|---|
| | Toner base Particles | No. | Amount (parts) | Pregrinding | No. | Amount (parts) | Pregrinding | No. | Amount (parts) | No. | Amount (parts) | Pregrinding |
| Ex. 1 | 1 | — | — | — | 3 | 0.6 | Yes | 1 | 0.5 | 5 | 1.0 | Yes |
| Ex. 2 | 1 | 2 | 0.2 | Yes | 3 | 0.6 | Yes | 1 | 0.5 | 5 | 1.0 | Yes |
| Ex. 3 | 1 | — | — | — | 3 | 0.6 | Yes | 1 | 0.5 | 5 | 1.0 | Yes |
| Ex. 4 | 1 | — | — | — | 3 | 0.6 | Yes | — | — | 5 | 1.0 | Yes |
| Ex. 5 | 1 | — | — | — | 3 | 0.6 | No | 1 | 0.5 | 5 | 1.0 | No |
| Ex. 6 | 1 | — | — | — | 3 | 0.6 | Yes | 1 | 0.5 | 5 | 1.0 | Yes |
| Ex. 7 | 1 | — | — | — | 3 | 0.6 | No | 1 | 0.5 | 5 | 1.0 | No |
| Ex. 8 | 1 | — | — | — | 3 | 0.6 | Yes | 1 | 0.5 | 5 | 1.0 | Yes |
| Ex. 9 | 1 | — | — | — | 3 | 0.6 | Yes | 1 | 0.5 | 5 | 1.0 | Yes |
| Ex. 10 | 1 | — | — | — | 3 | 0.6 | Yes | 1 | 0.5 | 5 | 1.0 | Yes |
| Ex. 11 | 1 | — | — | — | 3 | 0.6 | Yes | 1 | 0.5 | 5 | 1.0 | Yes |
| Ex. 12 | 1 | — | — | — | 3 | 0.6 | Yes | 1 | 0.5 | 5 | 1.0 | Yes |
| Ex. 13 | 2 | | | | | | — | | | | | |
| Ex. 14 | 2 | — | — | — | 3 | 0.6 | Yes | 1 | 0.5 | 5 | 1.0 | Yes |
| Ex. 15 | 1 | — | — | — | 3 | 0.6 | Yes | 1 | 0.5 | 5 | 1.0 | Yes |
| Ex. 16 | 1 | — | — | — | 3 | 0.6 | Yes | 1 | 0.5 | 5 | 1.0 | Yes |
| Ex. 17 | 1 | — | — | — | 3 | 0.6 | Yes | 1 | 0.5 | 5 | 1.0 | Yes |

TABLE 1-1-continued

| | Toner base Particles | Small-size silica | | | Mid-size silica | | | Small-size titanium | | Large-size silica | | |
|---|---|---|---|---|---|---|---|---|---|---|---|---|
| | | No. | Amount (parts) | Pregrinding | No. | Amount (parts) | Pregrinding | No. | Amount (parts) | No. | Amount (parts) | Pregrinding |
| Comp. Ex. 1 | 1 | — | — | — | 3 | 0.6 | Yes | 1 | 0.5 | 5 | 1.0 | Yes |
| Comp. Ex. 2 | 1 | — | — | — | 3 | 0.6 | Yes | 1 | 0.5 | 5 | 1.0 | Yes |
| Comp. Ex. 3 | 1 | — | — | — | 3 | 0.6 | Yes | 1 | 0.5 | 5 | 1.0 | Yes |
| Comp. Ex. 4 | 1 | — | — | — | 3 | 0.6 | Yes | 1 | 0.5 | 5 | 1.0 | Yes |
| Comp. Ex. 5 | 1 | — | — | — | 3 | 0.6 | No | 1 | 0.5 | 5 | 1.0 | No |
| Comp. Ex. 6 | 1 | — | — | — | 3 | 0.6 | No | 1 | 0.5 | 5 | 1.0 | No |
| Comp. Ex. 7 | 1 | — | — | — | 3 | 0.6 | No | 1 | 0.5 | 5 | 1.0 | No |
| Comp. Ex. 8 | 1 | — | — | — | 3 | 0.6 | Yes | 1 | 0.5 | 5 | 1.0 | Yes |
| Comp. Ex. 9 | 1 | — | — | — | — | — | — | — | — | — | — | — |
| Comp. Ex. 10 | 1 | — | — | — | — | — | — | 1 | 0.5 | — | — | — |
| Comp. Ex. 11 | 1 | 2 | 0.2 | — | — | — | — | 1 | 0.5 | — | — | — |
| Comp. Ex. 12 | 1 | 2 | 0.2 | — | — | — | — | 1 | 0.5 | — | — | — |

TABLE 1-2

| | Premixing by HENSCHEL Mixer 2.0 L | | Fixation treatment unit 1 | |
|---|---|---|---|---|
| Ex. 1 | 40 m/s | 1 min | 1 | Heat treatment |
| Ex. 2 | 40 m/s | 1 min | 1 | Heat treatment |
| Ex. 3 | 40 m/s | 1 min | 1 | Heat treatment |
| Ex. 4 | 40 m/s | 1 min | 1 | Heat treatment |
| Ex. 5 | 40 m/s | 1 min | 1 | Heat treatment |
| Ex. 6 | 40 m/s | 1 min | 1 | Heat treatment |
| Ex. 7 | 40 m/s | 1 min | 1 | Heat treatment |
| Ex. 8 | 40 m/s | 1 min | 1 | Heat treatment |
| Ex. 9 | 40 m/s | 1 min | 1 | Heat treatment |
| Ex. 10 | 40 m/s | 1 min | 1 | Heat treatment |
| Ex. 11 | 40 m/s | 1 min | 2 | Wet treatment |
| Ex. 12 | 40 m/s | 1 min | 3 | Wet treatment |
| Ex. 13 | | | — | |
| Ex. 14 | 40 m/s | 1 min | 1 | Heat treatment |
| Ex. 15 | 40 m/s | 1 min | — | (No)— |
| Ex. 16 | 40 m/s | 1 min | — | (No)— |
| Ex. 17 | 40 m/s | 1 min | — | (No)— |

TABLE 1-2-continued

| | Premixing by HENSCHEL Mixer 2.0 L | | Fixation treatment unit 1 | |
|---|---|---|---|---|
| Comp. Ex. 1 | 40 m/s | 1 min | — | (No)— |
| Comp. Ex. 2 | 40 m/s | 1 min | — | (No)— |
| Comp. Ex. 3 | 40 m/s | 1 min | — | (No)— |
| Comp. Ex. 4 | 40 m/s | 1 min | — | (No)— |
| Comp. Ex. 5 | 40 m/s | 1 min | — | (No)— |
| Comp. Ex. 6 | 40 m/s | 1 min | — | (No)— |
| Comp. Ex. 7 | 40 m/s | 1 min | — | (No)— |
| Comp. Ex. 8 | 40 m/s | 1 min | 1 | Heat treatment |
| Comp. Ex. 9 | — | — | — | (No)— |
| Comp. Ex. 10 | 40 m/s | 1 min | — | (No)— |
| Comp. Ex. 11 | 40 m/s | 1 min | 1 | Heat treatment |
| Comp. Ex. 12 | 40 m/s | 1 min | — | (No)— |

TABLE 2-1

| | Toner | Small-size silica | | | Mid-size silica | | | Small-size titanium | | Large-size silica | | |
|---|---|---|---|---|---|---|---|---|---|---|---|---|
| | | No. | Amount | Pregrinding | No. | Amount | Pregrinding | No. | Amount | No. | Amount | Pregrinding |
| Ex. 1 | 1 | 2 | 0.2 | Yes | — | — | — | — | — | — | — | — |
| Ex. 2 | 2 | — | — | — | — | — | — | — | — | — | — | — |
| Ex. 3 | 3 | — | — | — | — | — | — | — | — | — | — | — |
| Ex. 4 | 4 | 2 | 0.2 | Yes | — | — | — | 1 | 0.5 | — | — | — |
| Ex. 5 | 5 | 2 | 0.2 | No | — | — | — | — | — | — | — | — |
| Ex. 6 | 6 | 2 | 0.2 | Yes | — | — | — | — | — | — | — | — |
| Ex. 7 | 7 | 2 | 0.2 | No | — | — | — | — | — | — | — | — |
| Ex. 8 | 8 | 2 | 0.2 | Yes | 3 | 0.3 | Yes | — | — | — | — | — |
| Ex. 9 | 9 | 2 | 0.2 | Yes | — | — | — | — | — | 5 | 0.5 | Yes |
| Ex. 10 | 10 | 2 | 0.5 | Yes | — | — | — | — | — | — | — | — |
| Ex. 11 | 11 | 2 | 0.2 | Yes | — | — | — | — | — | — | — | — |
| Ex. 12 | 12 | 2 | 0.2 | Yes | — | — | — | — | — | — | — | — |
| Ex. 13 | 13 | 2 | 0.2 | Yes | — | — | — | — | — | — | — | — |
| Ex. 14 | 14 | 2 | 0.2 | Yes | — | — | — | — | — | — | — | — |
| Ex. 15 | 15 | 2 | 0.2 | Yes | — | — | — | — | — | — | — | — |
| Ex. 16 | 16 | 2 | 0.2 | Yes | — | — | — | — | — | — | — | — |
| Ex. 17 | 17 | 2 | 0.2 | Yes | — | — | — | — | — | — | — | — |
| Comp. Ex. 1 | 18 | 2 | 0.2 | No | — | — | — | — | — | — | — | — |
| Comp. Ex. 2 | 19 | 2 | 0.2 | Yes | — | — | — | — | — | — | — | — |
| Comp. Ex. 3 | 20 | 2 | 0.5 | Yes | — | — | — | — | — | — | — | — |

TABLE 2-1-continued

| | | Small-size silica | | | Mid-size silica | | | Small-size titanium | | Large-size silica | | |
|---|---|---|---|---|---|---|---|---|---|---|---|---|
| | Toner | No. | Amount | Pregrinding | No. | Amount | Pregrinding | No. | Amount | No. | Amount | Pregrinding |
| Comp. Ex. 4 | 21 | 2 | 0.2 | Yes | — | — | — | — | — | — | — | — |
| Comp. Ex. 5 | 22 | 2 | 0.2 | No | — | — | — | — | — | — | — | — |
| Comp. Ex. 6 | 23 | 2 | 0.5 | No | — | — | — | — | — | — | — | — |
| Comp. Ex. 7 | 24 | 2 | 0.2 | No | — | — | — | — | — | — | — | — |
| Comp. Ex. 8 | 25 | 2 | 0.8 | Yes | — | — | — | — | — | — | — | — |
| Comp. Ex. 9 | 26 | 2 | 0.5 | Yes | 3 | 0.6 | Yes | 1 | 0.5 | 5 | 0.5 | Yes |
| Comp. Ex. 10 | 27 | 2 | 0.2 | No | 3 | 1.2 | No | — | — | 5 | 1.5 | No |
| Comp. Ex. 11 | 28 | 2 | 0.5 | No | 3 | 0.6 | Yes | — | — | 5 | 3 | Yes |
| Comp. Ex. 12 | 29 | 2 | 0.5 | Yes | 3 | 2.0 | No | — | — | 5 | 1.5 | No |

TABLE 2-2

| | External additive treatment conditions | | | |
|---|---|---|---|---|
| Ex. 1 | 40 m/s | 3 min | 30° C. | Henschel |
| Ex. 2 | — | — | — | — |
| Ex. 3 | — | — | — | — |
| Ex. 4 | 40 m/s | 3 min | 30° C. | Henschel |
| Ex. 5 | 40 m/s | 3 min | 30° C. | Henschel |
| Ex. 6 | 40 m/s | 3 min | 15° C. | Henschel |
| Ex. 7 | 40 m/s | 3 min | 15° C. | Henschel |
| Ex. 8 | 40 m/s | 3 min | 30° C. | Henschel |
| Ex. 9 | 40 m/s | 3 min | 30° C. | Henschel |
| Ex. 10 | 40 m/s | 3 min | 30° C. | Henschel |
| Ex. 11 | 40 m/s | 3 min | 30° C. | Henschel |
| Ex. 12 | 40 m/s | 3 min | 30° C. | Henschel |
| Ex. 13 | 40 m/s | 3 min | 30° C. | Henschel |
| Ex. 14 | 40 m/s | 3 min | 30° C. | Henschel |
| Ex. 15 | 40 m/s | 3 min | 30° C. | Henschel |
| Ex. 16 | 50 m/s | 5 min | 30° C. | Henschel |
| Ex. 17 | 55 m/s | 5 min | 30° C. | Q Mixer |
| Comp. Ex. 1 | 40 m/s | 3 min | 30° C. | Henschel |
| Comp Ex. 2 | 40 m/s | 3 min | 15° C. | Henschel |
| Comp. Ex. 3 | 40 m/s | 3 min | 30° C. | Henschel |
| Comp. Ex. 4 | 20 m/s | 3 min | 30° C. | Henschel |
| Comp Ex. 5 | 40 m/s | 3 min | 15° C. | Henschel |
| Comp. Ex. 6 | 40 m/s | 3 min | 30° C. | Henschel |
| Comp. Ex. 7 | 20 m/s | 3 min | 30° C. | Henschel |
| Comp. Ex. 8 | 40 m/s | 3 min | 30° C. | Henschel |
| Comp. Ex. 9 | 20 m/s | 3 min | 15° C. | Henschel |
| Comp. Ex. 10 | 20 m/s | 3 min | 15° C. | Henschel |
| Comp. Ex. 11 | 30 m/s | 3 min | 15° C. | Henschel |
| Comp. Ex. 12 | 20 m/s | 3 min | 15° C. | Henschel |

The amounts of the external additives in Table 1-1 and Table 2-1 are amounts (part(s) by mass) relative to 100 parts by mass of the toner base particles.

Example 13

Fixation was performed as follows.

Using a magnetic seal used for the production of the toner base particles 2, the mixture was heated up to 80° C. with stirring, and the temperature was maintained for 4.5 hours. The resultant was cooled down to 55° C., the following dispersion liquid was added to 100 parts by mass of toner base particles in a manner that as amounts of the external additives, Silica 3 was 0.6 parts by mass, Silica 5 was 1.0 part by mass, and Titania 1 was 0.5 parts by mass. The resultant was stirred for 2 hours with maintaining the temperature at 55° C., and was cooled to 25° C. through 30° C., followed by performing filtration. The resultant was sufficiently washed with ion-exchanged water to perform fixation. Moreover, external additives were added under the conditions presented in Table 2-1 and Table 2-2 to thereby obtain a "toner."

<Preparation of External Additive Dispersion Liquid>

Each of the dispersion liquid of Silica 3, the dispersion liquid of Silica 5, and the dispersion liquid of Titania 1 was prepared in the following manner. A container equipped with a stirrer and an ultrasonic homogenizer (US-150T) was charged with 500 parts by ion-exchanged water, 3 parts of a cationic surfactant NEOGEN RK (available from DKS Co., Ltd.), and 100 parts of the external additive. The resultant mixture was dispersed using ultrasonic waves by means of a ultrasonic homogenizer for 10 minutes at 200 μA, followed by transferring the resultant dispersion liquid into a container equipped with a TK mixer stirrer, a temperature sensor, and a temperature control unit for a water temperature. After treating the dispersion liquid for 10 minutes at 12,000 rpm, it was confirmed that there was no sedimentation to thereby prepare each dispersion liquid.

<Measurement of Number Distribution D>

The density a of the toner base particles on a carbon tape and the density b of particles (powder particles B) detached from the toner base particles and deposited on mica were measured by the following vacuum dispersion particle image analysis performed on the above-obtained toner. In Examples, the powder particles B means external additive particles.

A carbon double-sided tape for SEM E3605 (available from EM Japan Co., Ltd.) was bonded onto a surface of an aluminium pin stub (available from EM Japan Co., Ltd.) having a diameter of 25 mm and a pin of 8 mm, and mica stamped into a diameter of 10 mm was bonded onto the pin stub with the tape.

The pin stub was placed inside a disperser NEBULA 1 (available from Phenom-World), and the toner was placed at a sample inlet of the disperser. After reducing the pressure inside the disperser to 10 kPa, the sample inlet was open for about 0.1 seconds, and the toner was introduced inside the disperser. As a result of the introduction of the toner sample, the pressure inside the disperser increased to 20 kPa. The pressure was maintained for 1 minute, and the pressure inside the disperser was returned to ordinary pressure, and the pin stub was taken out. When the pressure inside the disperser was returned to ordinary pressure, air was introduced into the disperser at the rate of about 10 kPa/5 sec.

The densities (a and b) of the toner base particles on the carbon tape of the surface of the pin stub and the powder particles B on mica were calculated through observation under a desktop SEM proX PREMIUM (available from PHENOM-WORLD), and a measurement of a particle size distribution was performed by means of particle metric software (available from PHENOM-WORLD).

In the toner base particles analysis, 10 images of the magnifications of 2,000 times were selected. In the detached particles analysis, 10 images of the magnifications of 2,000 times were selected. On the image analysis, 50 nm was determined as a threshold.

X axis: particle diameter of powder particles B

Y axis: the number of powder particles B per toner base particle (number/toner)

Particle diameters of the powder particles B were measured in a measurement range of 500 nm or smaller, and a number distribution obtained by determining the number of the powder particles B with dividing ranges per 25 nm was plotted on a graph as presented in FIG. 1.

<Evaluation>

<<Evaluation Method>>

In the present disclosure, an evaluation was performed using the following evaluator.

The evaluation was performed by means of the evaluator which was a tandem system full color photocopier imagio MP C4503, available from Ricoh Company Limited, including four-color non-magnetic two-component developers and photoconductors for 4 colors, and part of which had been tuned. As a printing speed, the evaluation was performed with high-speed printing (45 sheets/min, A4 size).

1) Evaluation of Cleaning Performance in Low-temperature Low-humidity Environment After outputting 10,000 sheets of a chart having an image density of 5% in an environment having a temperature of 10° C. and relative humidity of 15%, 5,000 sheets of a chart having an image density of 1% were output, followed by outputting 10,000 sheets of a chart having an image density of 10%. Thereafter, a residual transfer toner on the photoconductor, which had been passed through the cleaning step, was transferred onto with Scotch Tape (available from Sumitomo 3M Limited), and the tape was adhered to white paper. The image density of the obtained tape was measured by X-Rite938 (available from X-Rite Inc.) and a difference with white paper was calculated. The result was evaluated based on the following evaluation criteria.

[Evaluation Criteria]

A: A difference with blank paper (white paper) was less than 0.005.

B: A difference with blank paper (white paper) was 0.005 or greater but less than 0.010.

C: A difference with blank paper (white paper) was 0.010 or greater but less than 0.020.

D: A difference with blank paper (white paper) was 0.020 or greater.

Note that, the toners evaluated as "C" or better have no problem on practical use in terms of the cleaning performance.

2) Filming in Low-temperature and Low-humidity Environment

After outputting 10,000 sheets of a chart having an image density of 5% in an environment having a temperature of 10° C. and relative humidity of 15%, 5,000 sheets of a chart having an image density of 1% were output, followed by outputting 10,000 sheets of a chart having an image density of 10%. Thereafter, the deposited components on the photoconductor was visually evaluated based on the following evaluation criteria.

[Evaluation Criteria]

A: There was no deposition, and it was excellent.

B: A cloudy mark was slightly observed.

C: Cloudy lines were observed.

D: There was a large cloudy area.

Note that, the toners evaluated as "C" or better have no problem on practical use in terms of the filming.

TABLE 3

| | Condition 1 | Condition 2 | The number of free | Evaluation 1 Cleaning | | |
|---|---|---|---|---|---|---|
| | Max value of the number/nm | Number % of 125 nm or smaller particles | external additive/ particles | Tape transfer density/Δ | Judgement | Evaluation 2 Filming |
| Ex. 1 | 150 | 20% | 644 | 0.002 | A | A |
| Ex. 2 | 150 | 7% | 469 | 0.007 | B | A |
| Ex. 3 | 175 | 6% | 382 | 0.005 | B | A |
| Ex. 4 | 150 | 22% | 762 | 0.002 | A | B |
| Ex. 5 | 175 | 11% | 1,028 | 0.002 | A | A |
| Ex. 6 | 150 | 21% | 741 | 0.001 | A | B |
| Ex. 7 | 150 | 27% | 964 | 0.008 | B | C |
| Ex. 8 | 150 | 16% | 1,002 | 0.001 | A | A |
| Ex. 9 | 200 | 13% | 1,070 | 0.014 | C | A |
| Ex. 10 | 150 | 27% | 939 | 0.009 | B | C |
| Ex. 11 | 150 | 16% | 693 | 0.002 | A | A |
| Ex. 12 | 175 | 19% | 566 | 0.001 | A | A |
| Ex. 13 | 150 | 17% | 593 | 0.002 | A | A |
| Ex. 14 | 150 | 18% | 562 | 0.004 | A | A |
| Ex. 15 | 150 | 29% | 1,416 | 0.009 | B | C |
| Ex. 16 | 150 | 24% | 1,166 | 0.007 | B | B |
| Ex. 17 | 150 | 22% | 998 | 0.005 | B | B |

TABLE 3-continued

| | Condition 1 | Condition 2 | The number of free | Evaluation 1 Cleaning | | |
|---|---|---|---|---|---|---|
| | Max value of the number/nm | Number % of 125 nm or smaller particles | external additive/ particles | Tape transfer density/Δ | Judgement | Evaluation 2 Filming |
| Comp. Ex. 1 | 125 | 32% | 1,610 | 0.011 | C | D |
| Comp. Ex. 2 | 125 | 32% | 1,597 | 0.017 | C | D |
| Comp. Ex. 3 | 125 | 35% | 1,699 | 0.016 | C | D |
| Comp. Ex. 4 | 125 | 32% | 1,645 | 0.020 | C | D |
| Comp. Ex. 5 | 125 | 33% | 1,852 | 0.023 | D | D |
| Comp. Ex. 6 | 125 | 40% | 1,817 | 0.042 | D | D |
| Comp. Ex. 7 | 125 | 33% | 1,936 | 0.038 | D | D |
| Comp. Ex. 8 | 125 | 42% | 1,100 | 0.016 | C | D |
| Comp. Ex. 9 | 175 | 33% | 1,447 | 0.012 | C | D |
| Comp. Ex. 10 | 225 | 21% | 1,487 | 0.013 | C | D |
| Comp. Ex. 11 | 225 | 31% | 1,614 | 0.052 | D | B |
| Comp. Ex. 12 | 100 | 25% | 1,448 | 0.019 | C | D |

In Table 3, "the number of free external additive" means the number of free external additive particles per toner base particle.

For example, embodiments of the present disclosure are as follows.

<1> A toner including;

base particles; and external additives deposited on the base particles, wherein the toner satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the toner into a vacuumed space from an inlet, and allowing the toner to crush against a surface of a substrate having the adhesive area composed of a carbon tape, and the mica disposed in a manner that the surface is orthogonal to a direction connecting between a center of the vacuumed space and a center of the inlet, Powder particles B: particles detached from the base particles, Condition 1; when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller, Condition 2: in the number distribution D, the number of particles having particle diameters of 125 nm or smaller is 30% or less.

<2> The toner according to <1>, wherein the external additives are at least one selected from the group consisting of silica, titania, alumina, a fluorine compound, and resin particles.

<3> A powder including:

base particles; and external additives deposited on the base particles, wherein the powder satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the powder into a vacuumed space from an inlet, and allowing the powder to crush against a surface of a substrate having the adhesive area composed of a carbon tape, and the mica disposed in a manner that the surface is orthogonal to a direction connecting between a center of the vacuumed space and a center of the inlet, Powder particles B: particles detached from the base particles, Condition 1: when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller, Condition 2: in the number distribution D, the number of particles having particle diameters of 125 nm or smaller is 30% or less.

<4> A two-component developer including:

a carrier; and the toner according to <1> or <2>.

<5> A toner stored unit including:

a unit; and the toner according to <1> or <2> stored in the unit.

<6> An image forming apparatus including:

an electrostatic latent image bearing member;

an electrostatic latent image forming unit configured to form an electrostatic latent image on the electrostatic latent image bearing member;

a developing unit, which includes a toner, and is configured to develop the electrostatic latent image formed on the electrostatic latent image bearing member with the toner to form a toner image;

a transferring unit configured to transfer the toner image formed on the electrostatic latent image bearing member onto a surface of a recording medium; and a fixing unit configured to fix the toner image transferred on the surface of the recording medium, wherein the toner is the toner according to <1> or <2>.

<7> An image forming method including:

forming an electrostatic latent image on an electrostatic latent image bearing member;

developing the electrostatic latent image formed on the electrostatic latent image bearing member with a toner to form a toner image;

transferring the toner image formed on the electrostatic latent image bearing member onto a surface of a recording medium; and fixing the toner image transferred on the surface of the recording medium, wherein the toner is the toner according to <1> or <2>.

The present disclosure can solve the above-described various problems existing in the art, and can provide a toner, which does not form defective images due to filming of external additives on a photoconductor, particularly when the toner is used repetitively for a long period in a low-temperature and low-humidity, and has excellent cleaning properties.

What is claimed is:

1. A toner comprising:

base particles; and external additives deposited on the base particles, wherein the base particles comprise a binder resin comprising a crystalline polyester resin, wherein the toner satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the toner into a vacuumed space from an inlet, and allowing the toner to crush against a surface of a substrate having the adhesive area composed of a carbon tape, and the mica disposed in a manner that the surface is orthogonal to a direction connecting between a center of the vacuumed space and a center of the inlet, Powder particles B: particles detached from the base particles, Condition 1: when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller, Condition 2: in the number distribution D, the number of particles having particle diameters of 125 nm or smaller is 30% or less.

2. The toner according to claim 1, wherein the Conditions 1 and 2 are as follows, Condition 1: when the number distribution D is presented in a graph by plotting the ranges of the particle diameters by 25 nm on a horizontal axis, and plotting the number of the powder particles B on a vertical axis, the maximum value of the number of the powder particles B lies in a range of greater than 125 nm but 150 nm or smaller, Condition 2: in the number distribution D, the number of particles having particle diameters of 125 nm or smaller is from 3% through 25%.

3. The toner according to claim 1, wherein the Conditions 1 and 2are as follows, Condition 1: when the number distribution D is presented in a graph by plotting the ranges of the particle diameters by 25 nm on a horizontal axis, and plotting the number of the powder particles B on a vertical axis, the maximum value of the number of the powder particles B lies in a range of greater than 150 nm but 175 nm or smaller, Condition 2: in the number distribution D, the number of particles having particle diameters of 125 nm or smaller is from 3% through 20%.

4. The toner according to claim 1, wherein the external additives are at least one selected from the group consisting of silica, titania, alumina, a fluorine compound, and resin particles.

5. A powder comprising:

base particles; and external additives deposited on the base particles, wherein the base particles comprise a binder resin comprising a crystalline polyester resin, wherein the powder satisfies Conditions 1 and 2 below, when a number distribution D of particle diameters of powder particles B generated from one base particle A is calculated from a density a of the base particles A and a density b of the powder particles B, where the base particles A are deposited on an adhesive area and the powder particles B are deposited on mica by feeding the powder into a vacuumed space from an inlet, and allowing the powder to crush against a surface of a substrate having the adhesive area composed of a carbon tape, and the mica disposed in a manner that the surface is orthogonal to a direction connecting between a center of the vacuumed space and a center of the inlet, Powder particles B: particles detached from the base particles, Condition 1: when the number distribution D is presented in a graph by plotting the ranges of the particle diameters by 25 nm on a horizontal axis, and plotting the number of the powder particles B on a vertical axis, a maximum value of the number of the powder particles B lies in any one of the ranges by 25 nm that are a range of greater than 125 nm but 150 nm or smaller, a range of greater than 150 nm but 175 nm or smaller, and a range of greater than 175 nm but 200 nm or smaller, Condition 2: in the number distribution D, the number of particles having particle diameters of 125 nm or smaller is 30% or less.

6. A two-component developer comprising:

a carrier; and the toner according to claim 1.

7. A toner stored unit comprising:

a unit; and the toner according to claim 1 stored in the unit.

8. An image forming apparatus comprising:

an electrostatic latent image bearing member;

an electrostatic latent image forming unit configured to form an electrostatic latent image on the electrostatic latent image bearing member;

a developing unit, which includes a toner, and is configured to develop the electrostatic latent image formed on the electrostatic latent image bearing member with the toner to form a toner image;

a transferring unit configured to transfer the toner image formed on the electrostatic latent image bearing member onto a surface of a recording medium; and a fixing unit configured to fix the toner image transferred on the surface of the recording medium, wherein the toner is the toner according to claim 1.

9. An image forming method comprising:

forming an electrostatic latent image on an electrostatic latent image bearing member;

developing the electrostatic latent image formed on the electrostatic latent image bearing member with a toner to form a toner image;

transferring the toner image formed on the electrostatic latent image bearing member onto a surface of a recording medium; and fixing the toner image transferred on the surface of the recording medium, wherein the toner is the toner according to claim 1.

* * * * *